US011105103B2

(12) United States Patent
McDermott et al.

(10) Patent No.: US 11,105,103 B2
(45) Date of Patent: Aug. 31, 2021

(54) PORTABLE DAVIT

(71) Applicant: GLOBAL BMU ACCESS TECHNOLOGIES, LLC, New York, NY (US)

(72) Inventors: John McDermott, E. Setauket, NY (US); Martin Wunder, Waltrop (DE)

(73) Assignee: GLOBAL BMU ACCESS TECHNOLOGIES, LLC, New York, NY (US)

( * ) Notice: Subject to any disclaimer, the term of this patent is extended or adjusted under 35 U.S.C. 154(b) by 0 days.

(21) Appl. No.: 16/593,109

(22) Filed: Oct. 4, 2019

(65) Prior Publication Data

US 2021/0102389 A1 Apr. 8, 2021

(51) Int. Cl.

| | |
|---|---|
| ***E04G 3/34*** | (2006.01) |
| ***E04G 3/32*** | (2006.01) |
| ***B66C 23/16*** | (2006.01) |
| ***E04G 3/30*** | (2006.01) |
| ***B66C 23/20*** | (2006.01) |
| *E04G 3/28* | (2006.01) |

(52) U.S. Cl.

CPC ..... *E04G 3/32* (2013.01); *B66C 23/166* (2013.01); *B66C 23/205* (2013.01); *E04G 3/30* (2013.01); *E04G 3/34* (2013.01); *E04G 2003/286* (2013.01)

(58) Field of Classification Search

CPC .... E04G 3/30; E04G 3/34; E04G 3/32; B66C 23/166; B66C 23/205; B60P 1/5428; B60P 1/5433; B60P 1/5438; B60P 1/5485

See application file for complete search history.

(56) References Cited

U.S. PATENT DOCUMENTS

| | | | | |
|---|---|---|---|---|
| 2,109,304 A * | 2/1938 | Ormsby | B66C 23/166 212/253 |
| 2,187,439 A | 1/1940 | Armstrong et al. | |
| 2,487,305 A * | 11/1949 | Bridegroom | B66C 23/36 414/543 |
| 2,496,401 A * | 2/1950 | McKinney | B66C 23/36 414/543 |
| 2,569,821 A | 10/1951 | Fredrick | |

(Continued)

FOREIGN PATENT DOCUMENTS

| | | |
|---|---|---|
| CN | 201990404 U | 9/2011 |
| CN | 203392702 U | 1/2014 |

(Continued)

*Primary Examiner* — Colleen M Chavchavadze

(74) *Attorney, Agent, or Firm* — Sorell, Lenna & Schmidt, LLP

(57) ABSTRACT

A portable davit includes a base having a mounting portion and a housing. The housing defines a cavity. An end of a mast is positioned within the cavity. A jib is coupled to another end of the mast. A connector is coupled to the jib. A hoist is coupled to a platform and includes a drive and a rope. An end of the rope is wound about the drive. Another end of the rope is coupled to the connector. The drive is configured to rotate relative to the platform in a first direction to decrease a distance between the platform and an end of the jib and to rotate relative to the platform in an opposite second direction to increase the distance between the platform and an end of the jib. Systems and methods of use are provided.

16 Claims, 24 Drawing Sheets

(56) References Cited

U.S. PATENT DOCUMENTS 2,592,993 A * 4/1952 Adams ..... B66C 13/18 414/543
2,670,086 A * 2/1954 Eisberg ..... B66C 23/36 212/252
2,881,029 A * 4/1959 Tollefsen ..... E04G 3/243 182/144
3,159,110 A * 12/1964 Wylie ..... E04G 3/34 104/246
3,237,718 A * 3/1966 Pearson ..... E04G 3/34 182/36
3,302,750 A * 2/1967 Arnold ..... B66C 23/205 182/112
3,601,342 A 8/1971 Piasecki
3,978,989 A * 9/1976 Avila, Jr. ..... B66C 23/205 212/176
4,386,680 A * 6/1983 Reed ..... B66B 9/00 182/142
4,545,558 A * 10/1985 Crudele ..... E04G 3/34 182/142
4,560,074 A 12/1985 Manning
4,621,741 A 11/1986 Boon
4,714,226 A * 12/1987 Tracy ..... E04G 3/34 182/142
5,064,078 A * 11/1991 Van Staveren ..... B60P 1/548 212/180
5,211,297 A * 5/1993 Vandervalk ..... B66C 23/42 212/179
5,337,908 A * 8/1994 Beck, Jr. ..... A61G 7/1015 104/126
5,423,652 A * 6/1995 Thiede ..... B66C 23/48 212/245
5,431,526 A * 7/1995 Peterson ..... B60P 1/5433 212/223
5,445,281 A * 8/1995 Hung ..... B60P 1/5433 212/179
5,445,487 A * 8/1995 Koscinski, Jr. ..... B60P 1/5433 212/232
5,456,655 A * 10/1995 Morris ..... A61G 7/1015 128/846
5,509,638 A * 4/1996 Leon-Vieito ..... B60D 1/50 254/270
5,590,618 A * 1/1997 Marshall ..... B63B 27/06 114/343
5,752,799 A * 5/1998 Carey ..... B60P 1/5471 224/403
5,782,446 A * 7/1998 Ghahremani ..... E04G 3/34 248/220.21
6,138,991 A * 10/2000 Myers, Jr. ..... B66C 23/44 212/180
6,152,675 A * 11/2000 Compton ..... B60P 1/5495 212/299
6,464,208 B1 * 10/2002 Smith ..... A61H 3/008 212/97
6,499,610 B2 12/2002 Spitsbergen
6,763,898 B1 7/2004 Roodenburg et al.
6,782,972 B1 * 8/2004 Hatch ..... E04D 15/00 182/102
6,830,130 B2 * 12/2004 Webb ..... B66C 19/02 182/102
6,830,423 B1 * 12/2004 Williams ..... B60P 1/5471 212/180
6,981,834 B1 * 1/2006 Henry ..... B60P 1/5471 212/299
7,328,811 B2 2/2008 Roodenburg et al.
7,350,770 B1 * 4/2008 Boyer ..... B66C 23/02 212/295
7,377,740 B2 * 5/2008 Panzarella ..... B60P 1/5433 414/543
7,416,169 B2 8/2008 Noeske et al.
7,537,085 B2 * 5/2009 Vetesnik ..... A62B 35/0068 182/3
7,607,546 B1 * 10/2009 Hopper ..... B66C 23/44 212/180
7,699,292 B2 * 4/2010 Barnett ..... B66C 23/20 212/292
8,167,153 B1 5/2012 Wattel
8,511,646 B1 * 8/2013 Woodard ..... B66C 23/485 254/334
8,550,065 B2 * 10/2013 Johnson ..... A47J 33/00 126/25 A
9,120,543 B2 9/2015 Toce
9,255,416 B1 2/2016 Snell et al.
9,630,816 B1 * 4/2017 Napieralski ..... B66C 23/005
10,106,995 B2 10/2018 Snell et al.
10,125,503 B2 * 11/2018 Misiolek ..... E04G 5/00
10,343,581 B1 * 7/2019 Leonard ..... B60P 3/1016
10,435,277 B1 * 10/2019 Stubbs ..... B66C 23/207
2012/0223042 A1 * 9/2012 McNiff ..... B66C 23/166 212/295
2013/0168184 A1 * 7/2013 Tyler ..... B66F 11/00 182/3
2016/0159622 A1 * 6/2016 Narcisco ..... B66C 23/205 212/175
2016/0221802 A1 * 8/2016 Almeda ..... B66C 23/18
2018/0265172 A1 9/2018 Healy

FOREIGN PATENT DOCUMENTS

CN 204780427 U 11/2015
CN 206955489 U 2/2018
GB 2112737 A * 7/1983 ..... B60P 1/5433
GB 2237792 A * 5/1991 ..... B66C 1/66
JP 6109804 B2 4/2017

* cited by examiner

PORTABLE DAVIT

TECHNICAL FIELD

The present disclosure generally relates to davits, and more particularly to portable davits for supporting, raising and lowering scaffolds. Methods of producing and using the improved portable davits are provided.

BACKGROUND

The construction and maintenance of multi-story buildings, such as high-rise office and residential buildings is accomplished through the use of scaffolds. Some multi-story buildings include beams that extend from a roof, a setback, or a terrace of the building. The beams support the scaffolds, which are used by masons, glaziers, window washers and similar building repair and maintenance personnel to maintain the building. Winches include a cable or rope that is attached to a frame of the scaffold and to the beam on the roof. The winches may be manually operated or may be powered by electricity to raise or lower the scaffold to a selected level. The scaffolds must be sufficiently rigid and strong to ensure that the scaffold will not collapse or not fall apart. Various government codes and regulations mandate that a scaffold be able to meet certain safety standards with respect to strength, durability and failure resistance.

Conventional scaffold davits have become unduly heavy, complex and cumbersome in order to meet various safety standards. For example, some conventional scaffold davits have attempted to satisfy certain safety standards by constructing the scaffolds from large, strong components which also have a great deal of weight. These heavy davits require significant labor to assemble, disassemble and transport. Accordingly, conventional scaffold davits are assembled at a point of use, used over a finite period of time, are disassembled and stored, and are then reassembled at the same point of use. As such, one scaffold davit is typically required at each point of use. Because some buildings include many points of use, many scaffold davits will thus often be required to perform work and/or maintenance on just one building. Prior scaffold davits tend to be heavy, cumbersome structures that are labor intensive to assemble and to disassemble. They utilize components that provide structural rigidity at the expense of increased weight. This disclosure describes an improvement over these prior art technologies.

SUMMARY

In one embodiment, in accordance with the principles of the present disclosure, a portable davit comprises a base having a mounting portion and a housing coupled to the mounting portion. The housing comprises an inner surface defining a cavity. A mast comprises opposite first and second ends. The first end of the mast is positioned within the cavity. A jib includes opposite first and second ends. The first end of the jib is coupled to the second end of the mast. A connector is coupled to the jib. A hoist coupled to a platform. The hoist comprises a drive and a rope. The rope includes first and second ends. The first end of the rope is reeved through a traction hoist. The second end of the rope is coupled to the connector. The drive is configured to climb or descend the suspension rope relative to the platform in a first direction to decrease a distance between the platform and the second end of the jib and to climb or descend relative to the platform in an opposite second direction to increase the distance between the platform and the second end of the jib.

In one embodiment, in accordance with the principles of the present disclosure, a portable davit comprises a base having a mounting portion and a housing coupled to the mounting portion. The housing comprises an inner surface defining a cavity. The mounting portion comprises spaced apart first and second flanges. The flanges each comprise spaced apart first and second openings. The housing comprises a transport wheel. A mast comprises opposite first and second ends. The first end of the mast is positioned within the cavity. The mast is made from carbon fiber. The mast extends along a longitudinal axis between the first end of the mast and the second end of the mast. The mast is rotatable relative to the base about the longitudinal axis. A jib includes opposite first and second ends. The first end of the jib is coupled to the second end of the mast. The jib is made from carbon fiber. The jib comprises a track extending from the first end of the jib to the second end of the jib. The jib is pivotable relative to the mast between a first orientation in which the jib extends transverse to mast and a second orientation in which the jib extends parallel to the mast. A connector is positioned within the track such that the connector is movable relative to the jib along the track. A brake is rotatably coupled to the connector and configured to prevent movement of the connector along the track. A hoist coupled to a platform. The hoist comprises a drive and a rope. The rope includes first and second ends. The first end of the rope is wound about the drive. The second end of the rope is coupled to the connector. The drive is configured to rotate relative to the platform in a first direction to decrease a distance between the platform and the second end of the jib and to rotate relative to the platform in an opposite second direction to increase the distance between the platform and the second end of the jib.

In one embodiment, in accordance with the principles of the present disclosure, a portable davit comprises a first davit and a second davit. The first davit includes a first base comprising a first mounting portion and a first housing coupled to the first mounting portion. The first housing comprises a first inner surface defining a first cavity. A first mast comprises opposite first and second ends. The first end of the first mast is positioned within the first cavity. A first jib includes opposite first and second ends. The first end of the first jib is coupled to the second end of the first mast. A first connector is coupled to the first jib. A first hoist is coupled to the platform. The first hoist comprises a first drive and a first rope. The first rope includes first and second ends. The first end of the first rope is wound about the first drive. The second end of the first rope is coupled to the first connector. The second davit includes a second base comprising a second mounting portion and a second housing coupled to the second mounting portion. The second housing comprises a second inner surface defining a second cavity. A second mast comprises opposite first and second ends. The first end of the second mast is positioned within the second cavity. A second jib includes opposite first and second ends. The first end of the second jib is coupled to the second end of the second mast. A second connector is coupled to the second jib. A second hoist is coupled to the platform. The second hoist comprises a second drive and a second rope. The second rope includes first and second ends. The first end of the second rope is wound about the second drive. The second end of the second rope is coupled to the second connector. The drives are each configured to rotate relative to the platform in a first direction to decrease a distance between the platform and the second ends of the jibs and to rotate relative to the platform in an opposite second direction to increase the distance between the platform and the second ends of the jibs.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
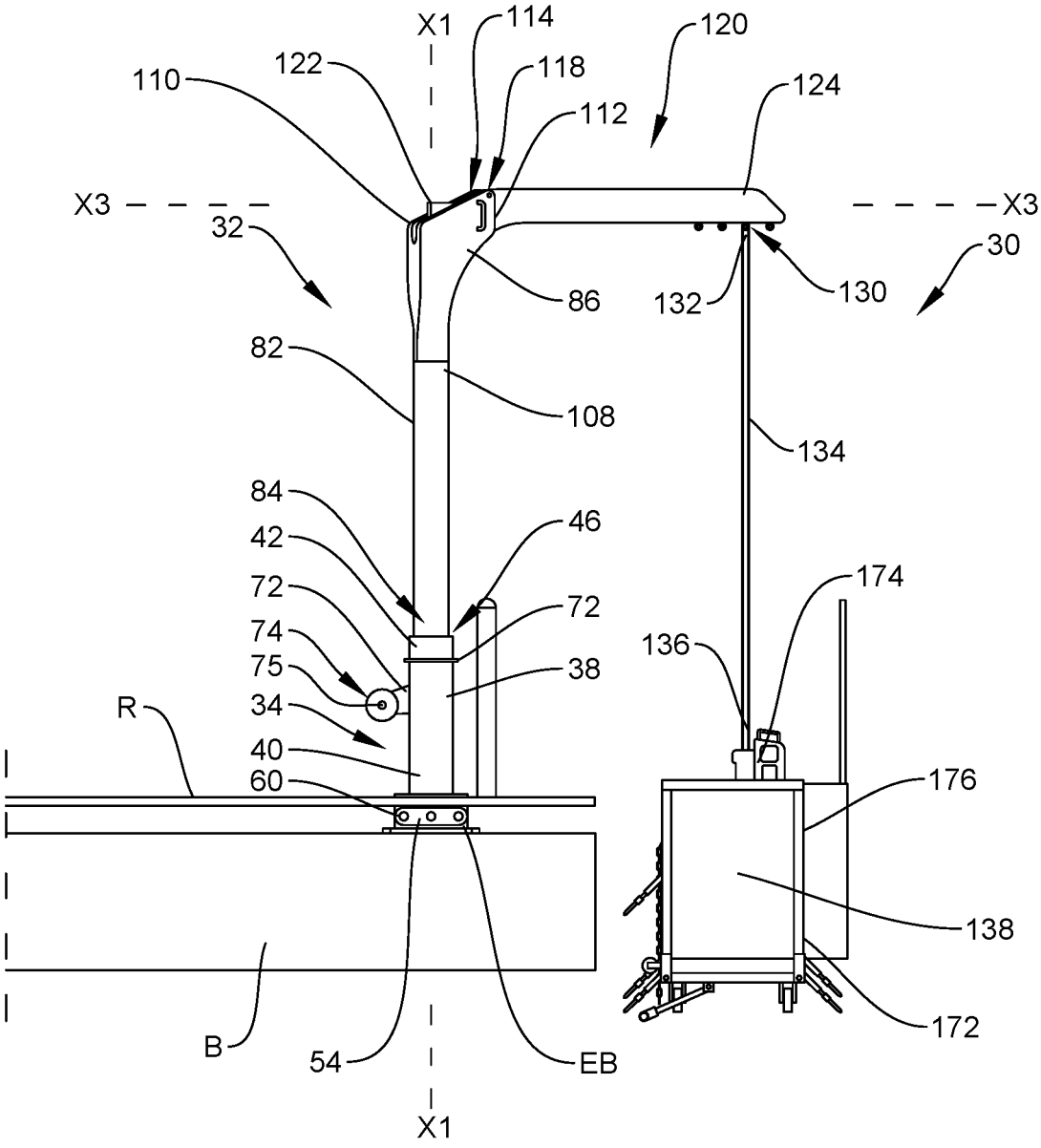
FIG. 1 is a side view of one embodiment of a portable davit system, in accordance with the principles of the present disclosure.
Figure 2:
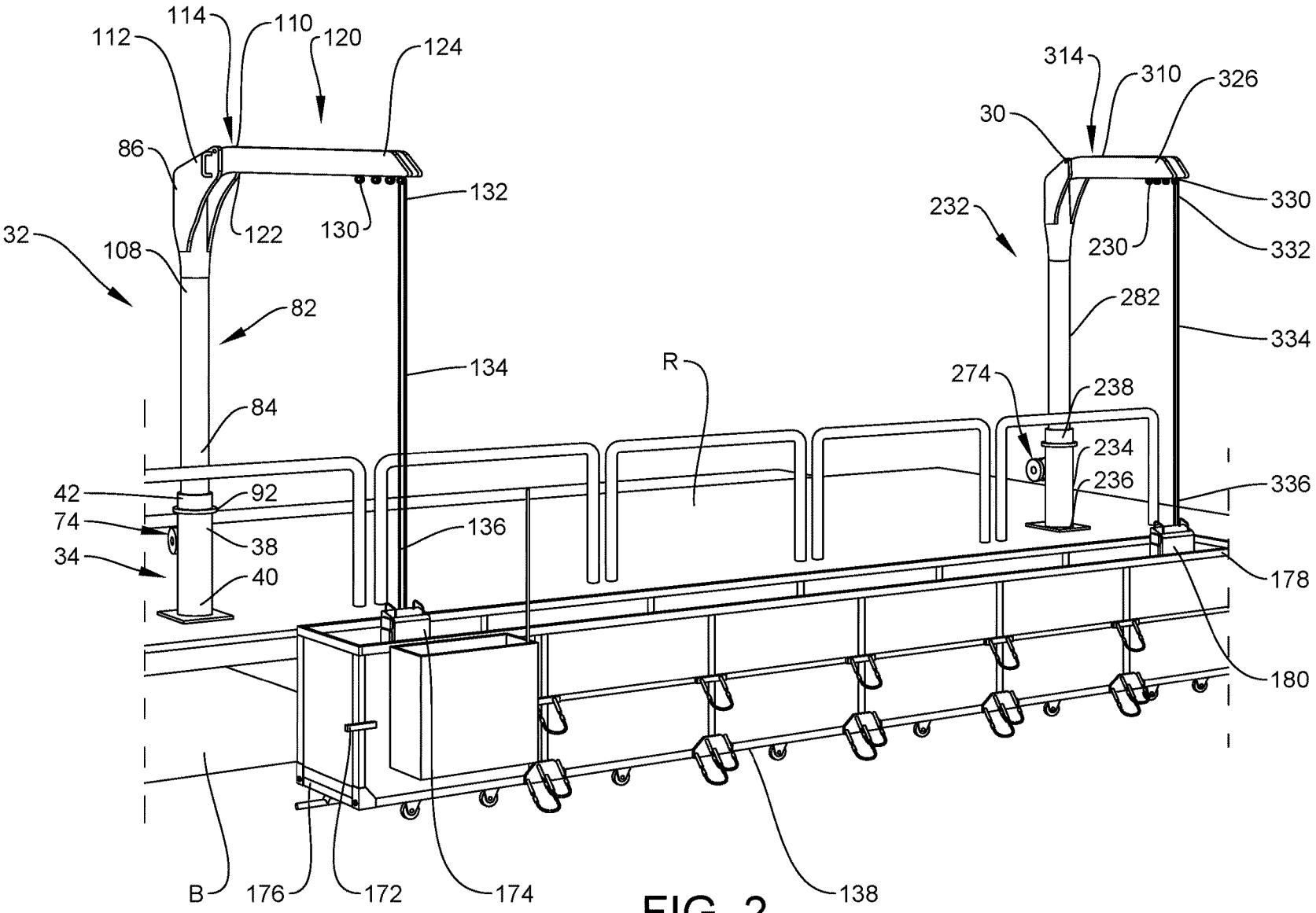
FIG. 2 is a perspective view of the portable davit system shown in FIG. 1.
Figure 3:
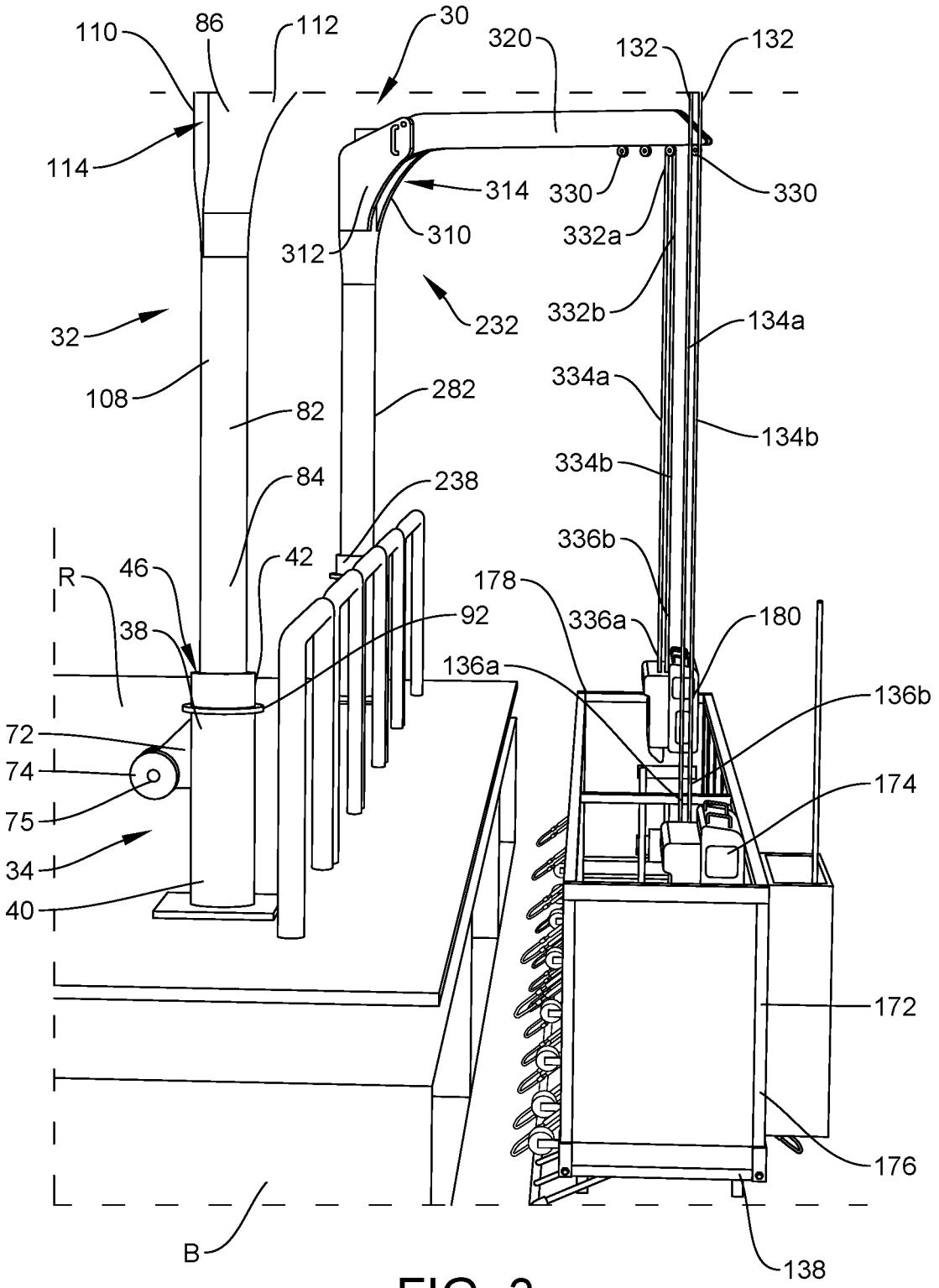
FIG. 3 is a perspective view of the portable davit system shown in FIG. 1.
Figure 4:
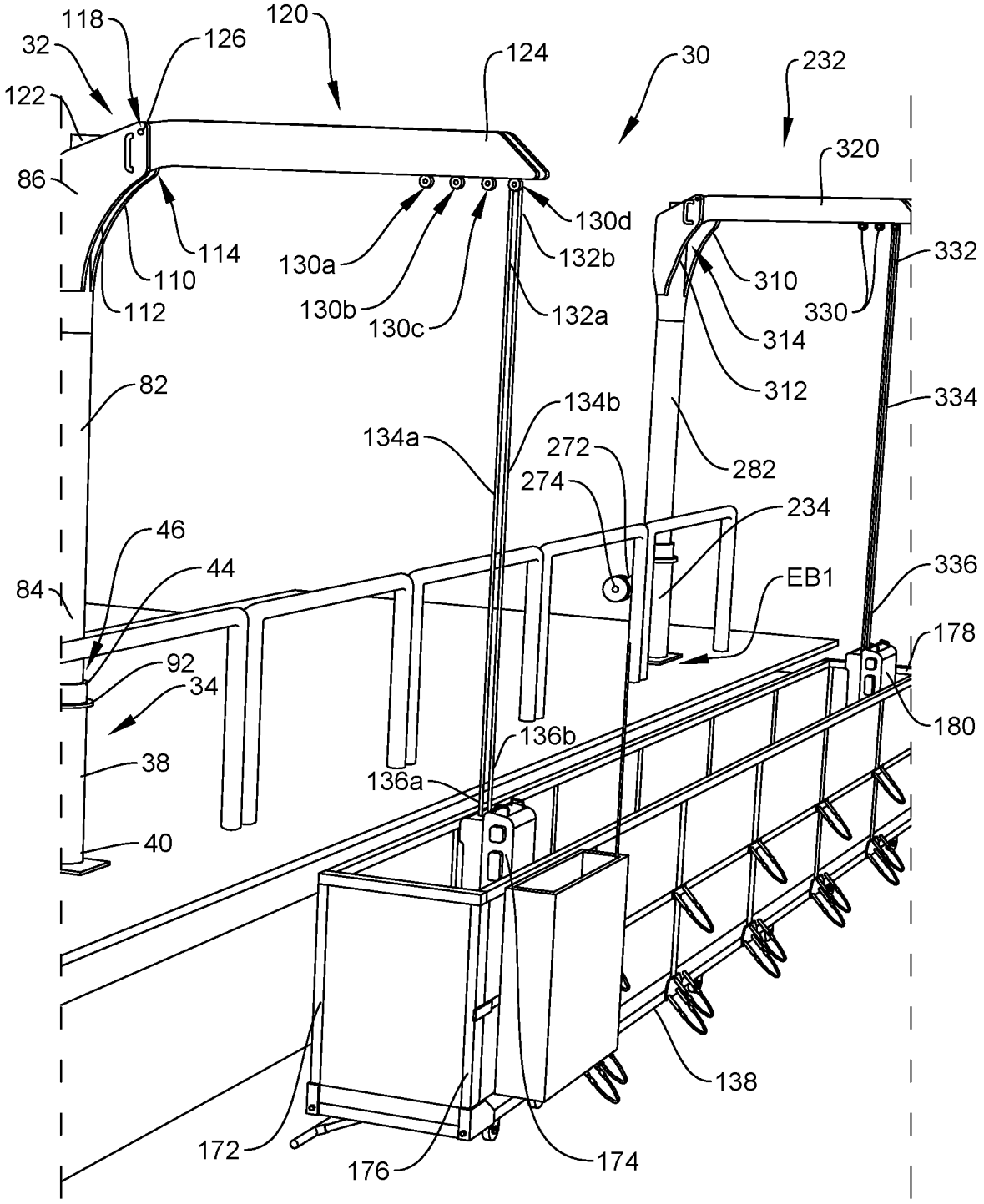
FIG. 4 is a perspective view of the portable davit system shown in FIG. 1.
Figure 5:
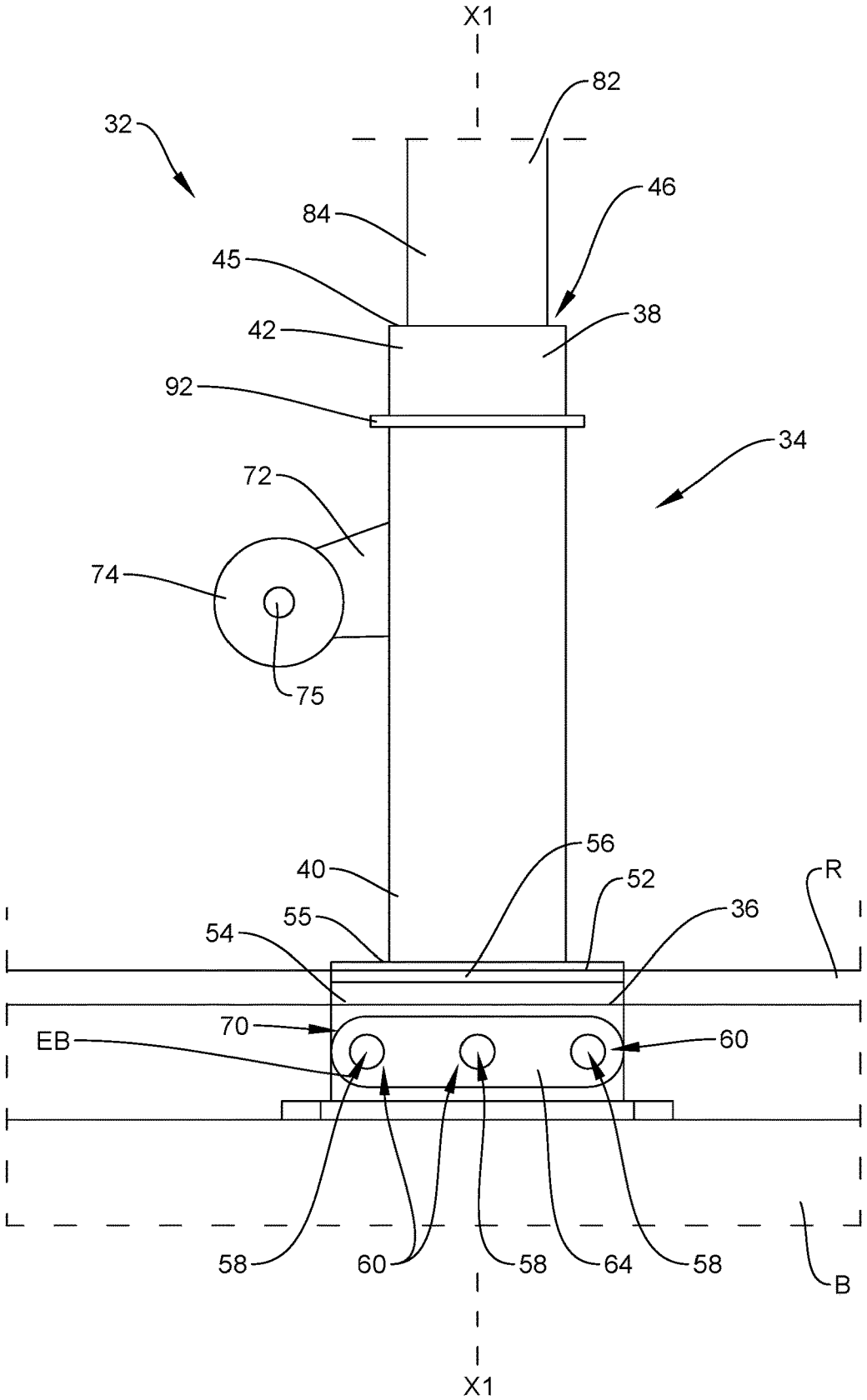
FIG. 5 is a side, breakaway view of components of the portable davit system shown in FIG. 1.
Figure 6:
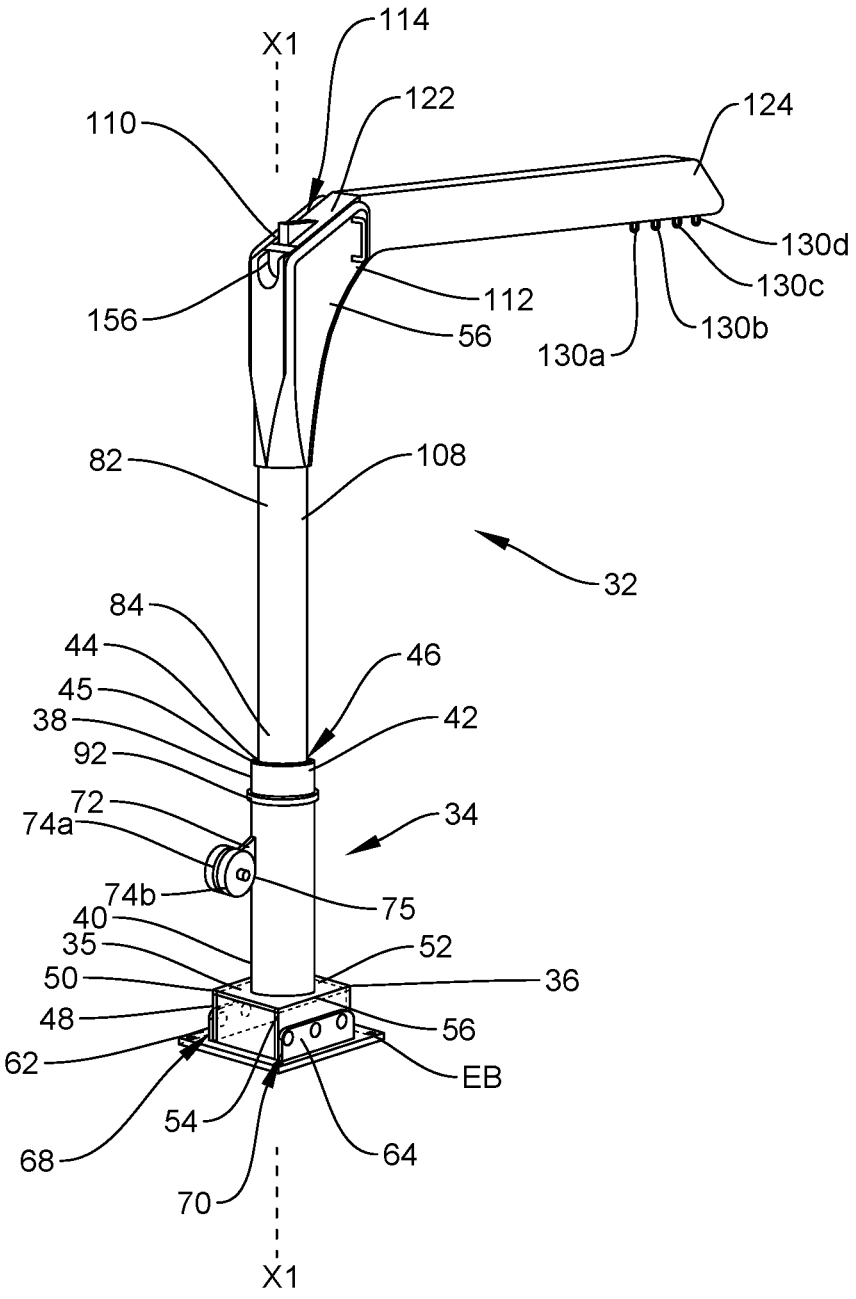
FIG. 6 is a perspective view of components of the portable davit system shown in FIG. 1.

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure. Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a portable davit system, related components and methods of using the portable davit system, in accordance with the principles of the present disclosure. Alternate embodiments are also disclosed. Reference will now be made in detail to the exemplary embodiments of the present disclosure, which are illustrated in the accompanying figures. Turning to FIGS. 1-28, there is illustrated components of a portable davit system 30.

The components of portable davit system 30 can be fabricated from materials including metals, polymers and/or composites, depending on the particular application. For example, the components of portable davit system 30, individually or collectively, can be fabricated from materials such as carbon fiber, fiberglass, aluminum, steel, iron, stainless steel, titanium, titanium alloys, cobalt-chrome, stainless steel alloys, semi-rigid and rigid materials, plastics, elastomers, rubbers and/or rigid polymers. Various components of portable davit system 30 may have material composites, including the above materials, to achieve various desired characteristics such as strength, rigidity, elasticity, performance and durability. The components of portable davit system 30, individually or collectively, may also be fabricated from a heterogeneous material such as a combination of two or more of the above-described materials. The components of portable davit system 30 can be extruded, molded, injection molded, cast, pressed and/or machined. The components of portable davit system 30 may be monolithically formed, integrally connected or include fastening elements and/or instruments, as described herein.

In some embodiments, portable davit system 30 includes a davit having at least some components that are made from lightweight materials, such as, for example, carbon fiber to allow for the transfer of portable davit system 30 from roof to roof using only two workers, while not exceeding government or agency guidelines for personnel manual lifting limits. In some embodiments, the boom/jib and mast are made partially or entirely of carbon fiber to keep weight manageable. In some embodiments, portable davit system 30 includes a foldable mast to provide for portability as well as safer operation and storage versus davit systems the require that the mast and boom/jib be separated manually. In some embodiments, portable davit system 30 does not include a truss between the mast and the jib to allow for greater variation of travel along the jib, such as, for example, within a boom trolley of the jib, as discussed herein. In some embodiments, the boom/jib of portable scaffold davit 30 can be extended or retracted to adjust the outreach. The added outreach to weight ratio will allow previously permanent davits to be portable. In some embodiments, portable davit system 30 is configured to replace various types of davits, such as, for example, 1,000 lbs. davits, 1,150 lbs. davits and/or 1,250 lbs. davits. In some embodiments, portable davit system 30 is configured to replace various types of davits without replacing the existing bases/mounting brackets on the building.

In some embodiments, portable davit system 30 includes a foldable carbon fiber jib. In some embodiments, portable davit system 30 positions heavy parts close to the ground and lightweight parts on top in a manner that provides extreme low center of mass for safe maneuvering on the roof. In some embodiments, portable davit system 30 is configured to be connected to conventional davit bases.

Portable davit system 30 includes a davit, such as, for example, a first davit 32 having a base 34 comprising a mounting portion 36 and a housing 38 coupled to mounting portion 36. In some embodiments, housing 38 is monolithically and/or integrally formed with mounting portion 36 such that housing 38 cannot be removed or separated from mounting portion 36 without breaking housing 38 and/or mounting portion 36. In some embodiments, housing 38 can be variously coupled to mounting portion 36 by threads, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts. Mounting portion 36 is configured to be coupled to an existing bracket of a building, such as, for example, an existing bracket EB on a roof R of a building B to couple davit 32 to building B, as discussed herein.

Housing 38 extends along a longitudinal axis X1 between an end 40 and an opposite end 42. End 40 is coupled directly to mounting portion 36. In some embodiments, end 40 is monolithically and/or integrally formed with mounting portion 36 such that end 40 cannot be removed or separated from mounting portion 36 without breaking end 40 and/or mounting portion 36. An inner surface 44 of housing 38 defines a cavity 46. Cavity 46 extends parallel to axis X1. In some embodiments, cavity 46 is coaxial with axis X1. In some embodiments, cavity 46 has a uniform diameter along an entire length of housing 38. In some embodiments, cavity 46 may have various cross section configurations, such as, for example, circular, oval, oblong, triangular, rectangular, square, polygonal, irregular, uniform, non-uniform, variable, tubular and/or tapered. In some embodiments, a top surface 55 of body 52 defines a bottom of cavity 46. In some embodiments, existing bracket EB and/or all or a portion of base 34, such as, for example, housing 38 is made from steel and/or aluminum.

In some embodiments, mounting portion 36 includes a flange 48 extending from a side 50 of a body 52 of mounting portion 36 and a flange 54 extending from an opposite side 56 of body 54. Flanges 48, 54 each include one or a plurality of apertures 58. In one embodiment, shown in FIGS. 10 and 11, flange 48 includes a flange 48*a* and a flange 48*b* that is spaced apart from flange 48*a* and flange 54 includes a flange 54*a* and a flange 54*b* that is spaced apart from flange 54*a*. Flanges 48*a*, 48*b*, 54*a*, 54*b* each include a single aperture 58. Apertures 58 are each configured for alignment with a hole 60 of spaced apart flanges 62, 64 of existing bracket EB. Davit 32 comprises one or a plurality of pegs 66. In some embodiments, pegs 66 are each configured to extend simultaneously through one of apertures 58 and one of holes 60 to fix base 34 to existing bracket EB. In some embodiments, flange 62 includes a channel 68 configured for disposal of flange 48 or flanges 48*a*, 48*b* and flange 64 includes a channel 70 configured for disposal of flange 54 or flanges 54*a*, 54*b*. For example, flange 48 or flanges 48*a*, 48*b* can be disposed in channel 68 and flange 54 or flanges 54*a*, 54*b* can be disposed in channel 70 to align apertures 58 with holes 60 such that pegs 66 can simultaneously be inserted through one of apertures 58 and one of holes 60 to fix base 34 to existing bracket EB. In some embodiments, flanges 48, 54 extend parallel to one another. In some embodiments, pegs 66 are fasteners, such as, for example, threaded bolts and system 30 includes threaded nuts that are configured to mate with the threaded bolts to fix base 34 to existing bracket EB. In some embodiments, at least a portion of mounting portion 36, such as, for example, body 54 and/or flanges 48, 54 are made from aluminum to provide improved shock and impact resistance versus mounting portions that are made from lighter materials, such as, for example, fiber carbon or fiber glass.

Figure 9:
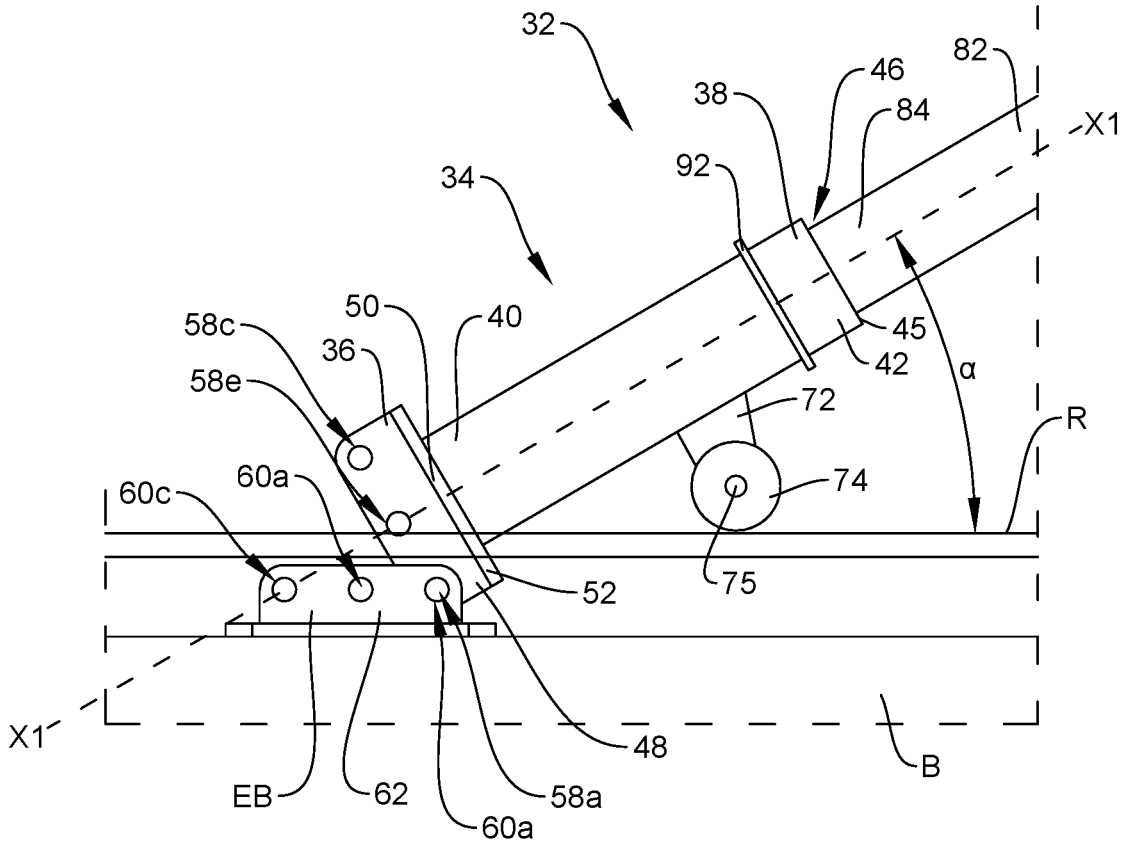
FIG. 9 is a side, breakaway view of components of the portable davit system shown in FIG. 1.
Figure 16:
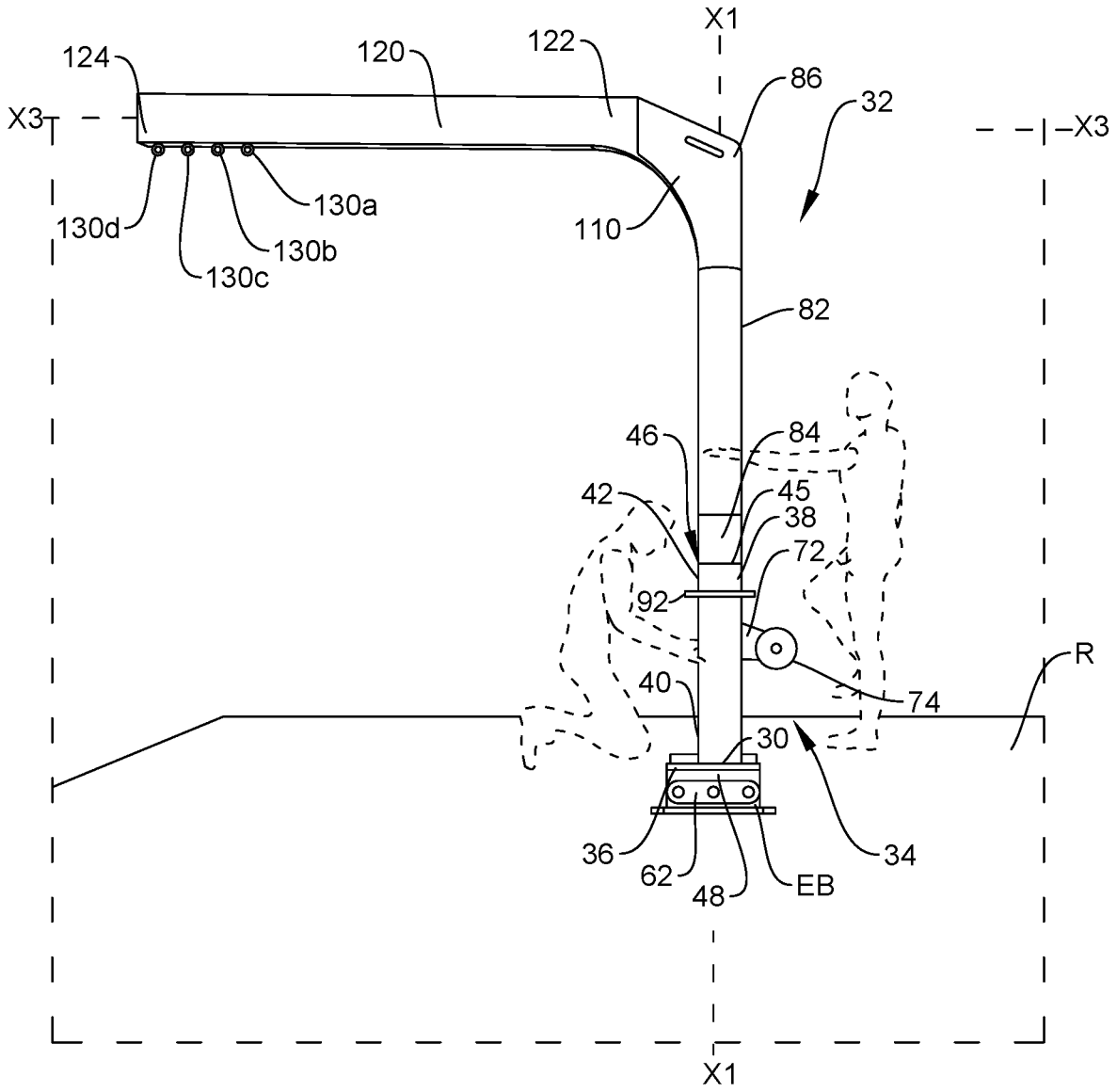
FIG. 16 is a side view of components of the portable davit system shown in FIG. 1.

In some embodiments, base 34 includes a bracket 72 that is coupled to housing 38 and one or a plurality of wheels, such as, for example, transport wheels 74 that are rotatably coupled to bracket 72. In some embodiments, wheels 74 include a first wheel 74*a* and a second wheel 74*b*. Wheel 74*a* is positioned on a first side of bracket 72 and wheel 74*b* is positioned on an opposite second side of bracket 72 such that wheels 74*a*, 74*b* are spaced apart from one another by bracket 72. An axle 75 extends through wheels 74*a*, 74*b* and bracket 72 to connect wheels 74*a*, 74*b* with bracket 72. Wheels 74 are configured to support base 34 while davit 32 is being assembled and unassembled and/or when davit 32 is being moved from one location to another location, such as, for example, one location on roof R to another location on roof R. For example, in one embodiment, base 34 can be connected with existing bracket EB by tilting base 34 such that axis X1 extends at an angle $\alpha$ relative to roof R, as shown in FIG. 9, and the majority of the weight of davit 32 is carried by wheels 74. Wheels 74 rotate relative to bracket 72 to translate base 34 along roof R and position mounting portion 36 adjacent to existing base EB such that flange 48 or at least one of flanges 48*a*, 48*b* is/are positioned within channel 68 and one of apertures 58 of flange 48 or aperture 58 of flange 48*a* or flange 48*b* is aligned with one of holes 60 of flange 62. Two of apertures 58 of flange 48 or aperture 58 of flange 48*a* or flange 48*b* is/are spaced apart from holes 60 of flange 62 such that only one aperture 58 of flange 48 or flanges 48*a*, 48*b* is aligned with only one hole 60 of flange 62. One of pegs 66 is inserted into the aligned aperture 58 and hole 60 of flange 48 and flange 62. Mounting portion 36 is positioned relative to existing base 34 such that flange 54 or at least one of flanges 54*a*, 54*b* are positioned within channel 70 and one of apertures 58 of flange 54 or aperture 58 of flange 54*a* or flange 54*b* is aligned with one of holes 60 of flange 64. Two of apertures 58 of flange 54 or aperture 58 of flange 54*a* or flange 54*b* is spaced apart from holes 60 of flange 64 such that only one aperture 58 of flange 54 or flanges 54*a*, 54*b* is aligned with only one hole 60 of flange 64. One of pegs 66 is inserted into the aligned aperture 58 and hole 60 of flange 54 and flange 64. Base 34 is then tilted relative to existing bracket EB such that axis L1 extends perpendicular to roof R, as shown in FIG. 16, and apertures 58 of flange 48 or aperture 58 of flange 48*a* or flange 48*b* are each aligned with one of holes 60 of flange 62 and apertures 58 of flange 54 or aperture 58 of flange 54*a* or flange 54*b* are each aligned with one of holes 60 of flange 64. One of pegs 66 is inserted into each of the aligned apertures 58 and holes 60 of flange 48 and flange 62. One of pegs 66 is inserted into each of the aligned apertures 58 and hole 60 of flange 54 and flange 64. In some embodiments, angle $\alpha$ is an acute angle. In some embodiments, angle $\alpha$ is an angle between about 5 degrees and 75 degrees. In some embodiments, angle $\alpha$ is an acute angle. In some embodiments, angle $\alpha$ is an angle between about 10 degrees and 45 degrees.

In one embodiment, base 34 can be disconnected from existing bracket EB by removing all but one of pegs 66 from flanges 48, 62 and removing all but one of pegs 66 from flanges 54, 64. Base 34 is then rotated relative to existing bracket EB about the one peg 66 that is inserted through flanges 48, 62 and the one peg 66 that is inserted through flanges 54, 64 such that axis X1 extends at angle $\alpha$ relative to roof R, as shown in FIG. 9. The one remaining peg 66 is removed from flanges 48, 62 and the one remaining peg 66 is removed from flanges 54, 64 such that base 34 can be lifted out of channels 68, 70 and removed from existing bracket EB. Base 34 can then be translated along roof R using wheels 74 to move base from existing bracket EB to another location on roof R, such as, for example, another existing base that is the same or similar to existing bracket EB.

Figure 12:
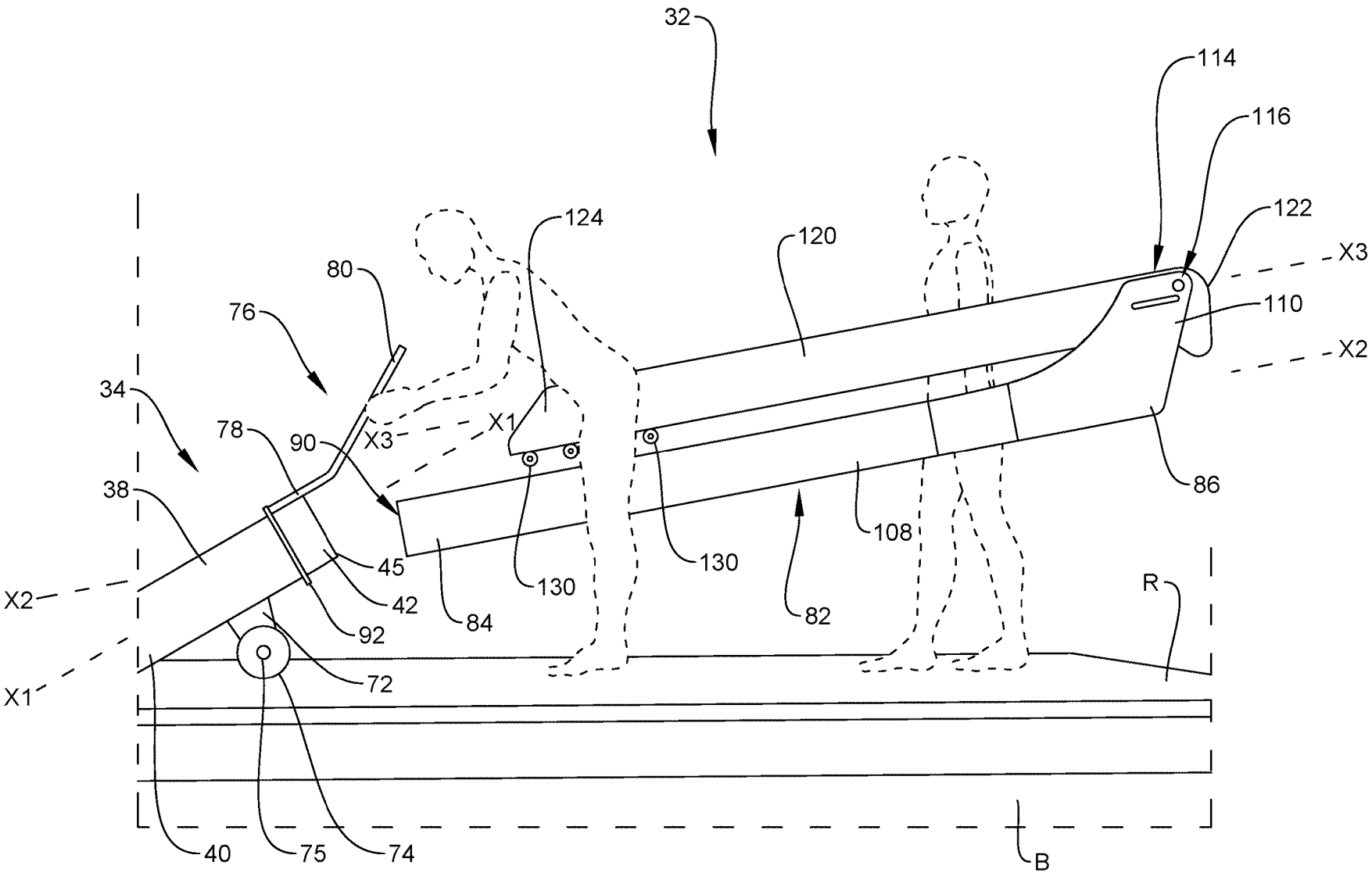
FIG. 12 is a side view of components of the portable davit system shown in FIG. 1.
Figure 13:
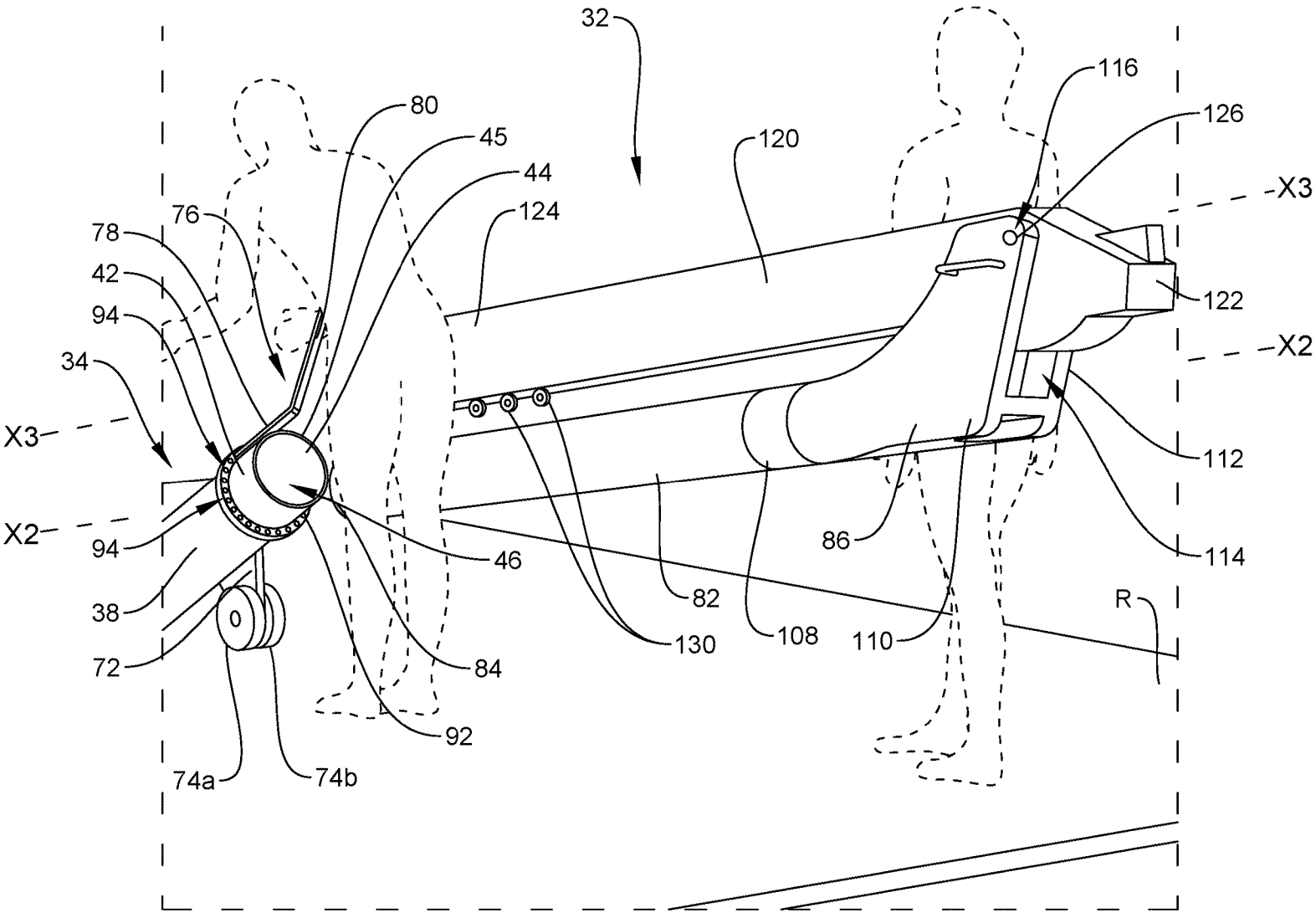
FIG. 13 is a perspective view of components of the portable davit system shown in FIG. 1.

In one embodiment, shown in FIGS. 12 and 13, base 34 includes a handle 76 that is coupled to housing 38 to assist in tilting base 34 relative to roof R and translating base 34 along roof R or another surface. Handle 76 includes a portion 78 that is coupled directly to housing 38 and extends parallel to axis X1 and a portion 80 that extends from portion 78 at an acute angle relative to axis X1. In some embodiments, handle 76 is removably coupled to base 34 such that handle 76 can be removed from base 34 after base 34 has been moved to a selected location and/or tilted relative to roof R or another surface. In some embodiments, handle 76 can be variously connected with base 34, such as, for example, by threads, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts. In some embodiments, handle 76 is permanently fixed to base 34 such that handle 76 cannot be separated or removed from base 34 without breaking base 34 and/or handle 76. In some embodiments, portion 80 may be disposed at alternate orientations, relative to portion 78, such as, for example, transverse, perpendicular and/or other angular orientations such as acute or obtuse, co-axial and/or may be offset or staggered.

Davit 32 includes a mast 82 extending along a longitudinal axis X2 between an end 84 and an opposite end 86. End 84 is configured to be positioned in cavity 46. Mast 82 includes an inner surface 88 that defines a passageway 90. Passageway 90 is in fluid communication with cavity 46 when end 84 is positioned in cavity 46. Passageway 90 extends parallel to axis X2. In some embodiments, passageway 90 is coaxial with axis X2. In some embodiments, passageway 90 has a uniform diameter along an entire length of mast 82. In some embodiments, passageway 90 may have various cross section configurations, such as, for example, circular, oval, oblong, triangular, rectangular, square, polygonal, irregular, uniform, non-uniform, variable, tubular and/or tapered. In some embodiments, all or a portion of mast 82 is made from a strong, lightweight material, such as, for example, carbon fiber. That is, all or a portion of mast 82 consists of and/or comprises a strong, lightweight material, such as, for example, carbon fiber.

Figure 18:
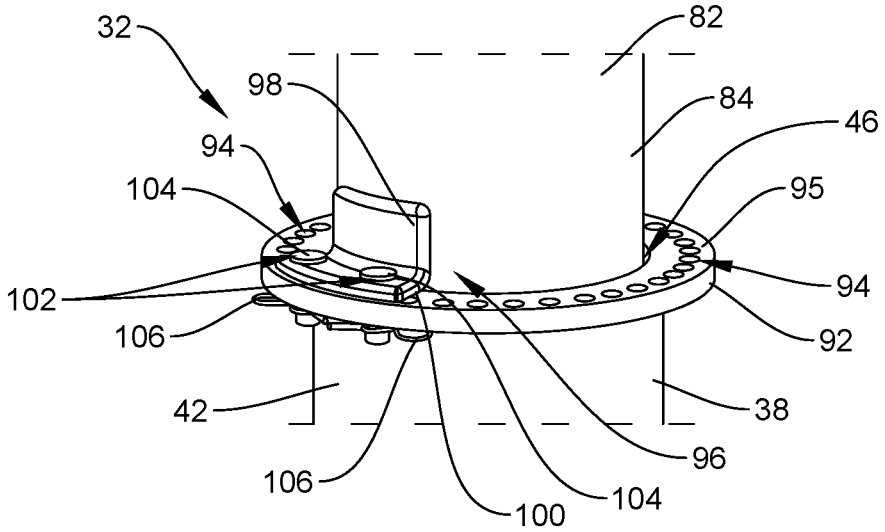
FIG. 18 is a perspective, breakaway view of components of the portable davit system shown in FIG. 1.

End 84 of mast 82 is positioned in cavity 46 such that mast 82 is rotatable relative to base 34 about axes X1, X2, as discussed herein. In some embodiments, base 34 includes a collar 92 that is permanently fixed to an outer surface of housing 38 such that collar 92 is positioned between a proximalmost surface 45 of end 42 and mounting portion 36, as shown in FIGS. 1-16. In some embodiments, collar 92 is permanently fixed to an outer surface of housing 38 such that a top surface 95 of collar 92 defines proximalmost surface of end 42, as shown in FIG. 18. In some embodiments, collar 92 is monolithically and/or integrally formed with housing 38 such that collar 92 cannot be removed or separated from housing 38 without breaking collar 92 and/or housing 38. Collar 92 includes a plurality of spaced apart holes 94 disposed radially about collar 92 and mast 82 includes a bracket 96 that is permanently fixed to an outer surface of mast 82, as best shown in FIG. 18. Bracket 96 includes a body 98 and a flange 100 that extends from body 98. Flange 100 includes one or a plurality of holes 102. Holes 102 are each configured to be aligned with one of holes 94 such that a plug 104 can be inserted simultaneously through one of holes 94 and one of holes 102 to prevent rotation of mast 82 relative to base 34 about axes X1, X2. Once plugs 104 are removed from holes 94, 102, mast 82 is able to rotate relative to base 34 about axes X1, X2. In some embodiments, plugs 104 are each maintained in holes 94, 102 via a pin, such as, for example, a cotter pin 106 that extends through a body of plug 104. In some embodiments, mast 82 is able to rotate 360° relative to base 34 about axes X1, X2 when plugs 104 are removed from holes 94, 102. In some embodiments, flange 100 may be disposed at alternate orientations, relative to body 98, such as, for example, transverse, perpendicular and/or other angular orientations such as acute or obtuse, co-axial and/or may be offset or staggered. In some embodiments, holes 94 and/or holes 102 may have various cross section configurations, such as, for example, circular, oval, oblong, triangular, rectangular, square, polygonal, irregular, uniform, non-uniform, variable, tubular and/or tapered.

Figure 17:
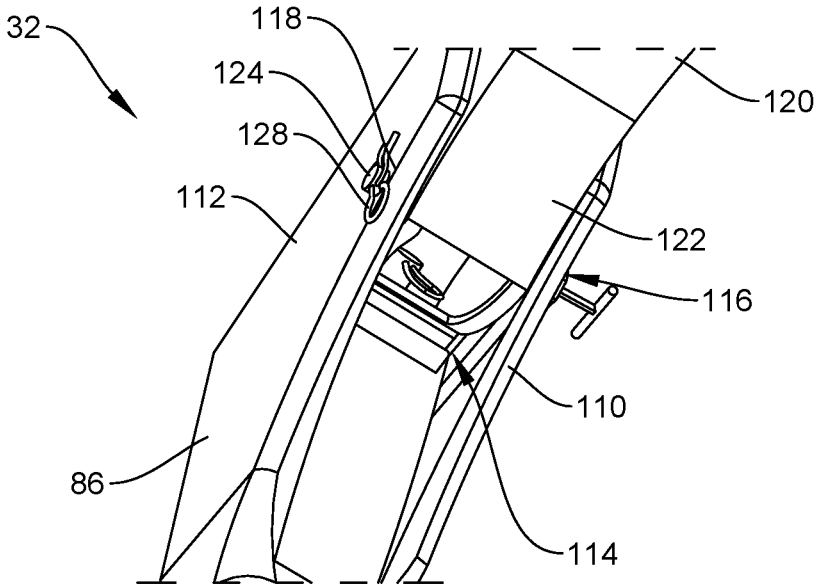
FIG. 17 is a perspective, breakaway view of components of the portable davit system shown in FIG. 1.

Mast 82 comprises a body 108 that includes surface 88 and passageway 90. End 86 includes spaced apart walls 110, 112 that each extend outwardly from body 108. Walls 110, 112 define a cavity 114 therebetween. Cavity 114 is in communication with passageway 90. Wall 110 includes an aperture 116 and wall 112 includes an aperture 118 that is aligned with aperture 116. Davit 32 includes a jib 120 extending along a longitudinal axis X3 between an end 122 and an opposite end 124. End 122 is pivotably positioned within cavity 114. End 124 includes a pathway that extends through a thickness of end 124 and is aligned with apertures 116, 118. In some embodiments, a dowel 126 extends simultaneously through the pathway in end 124 and apertures 116, 118 to connect jib 120 to mast 82. In some embodiments, dowel 126 maintained in apertures 116, 118 via a pin, such as, for example, a cotter pin 128 that extends through a body of dowel 126, as shown in FIG. 17. Dowel 126 defines a hinge configured to allow jib 120 to pivot relative to mast 82 to move jib 120 between a first orientation in which axis X3 extends transverse and/or perpendicular to axis X2 to a second orientation in which axis X3 extends parallel to axis X2, as discussed herein. In some embodiments, all or a portion of jib 120 is made from a strong, lightweight material, such as, for example, carbon fiber. That is, all or a portion of jib 120 consists of and/or comprises a strong, lightweight material, such as, for example, carbon fiber.

In some embodiments, as shown in FIGS. 1-4, 6, 7, 12, 13, 15 and 16, davit 32 includes one or a plurality of connectors 130 that are each coupled directly to jib 120. An end 132 of a cable, such as, for example, a rope 134 is coupled to one of connectors 130 and an opposite end 136 of rope 134 is coupled to a suspended platform or scaffold, such as, for example, a platform 138, as discussed herein. In some embodiments, davit 32 includes four spaced apart connectors 130, such as, for example, a connector 130*a*, a connector 130*b*, a connector 130*c* and a connector 130*d*. In some embodiments, rope 134 includes two ropes 134, such as, for example, a rope 134*a* and a rope 134*b*. Ends 132 of ropes 134*a*, 134*b* are each coupled to one of connectors 130 and ends 136 of ropes 134*a*, 134*b* are each coupled to platform 138. In some embodiments, connectors 130 are eyelets. In some embodiments, connectors 130 are fixed relative to jib 120 such that connectors 130 are prevented from moving along axis X3 relative to jib 120. In some embodiments, connectors 130 are monolithically and/or integrally formed with jib 120 such that connectors 130 cannot be removed or separated from jib 120 without breaking connectors 130 and/or jib 120. It is envisioned that by providing a plurality of connectors 130 will give a user option as to how far platform 138 is spaced apart from mast 82, for example. That is, should the user desire platform 138 to be closer to mast 82 (and hence building B), he or she can couple end 132 of rope 134 or ends 132 of ropes 134*a*, 134*a* to connector 130*a*. Should the user desire platform 138 to be farther away from mast 82 (and hence building B), he or she can couple end 132 of rope 134 or ends 132 of ropes 134*a*, 134*a* to connector 130*d*.

Figure 7:
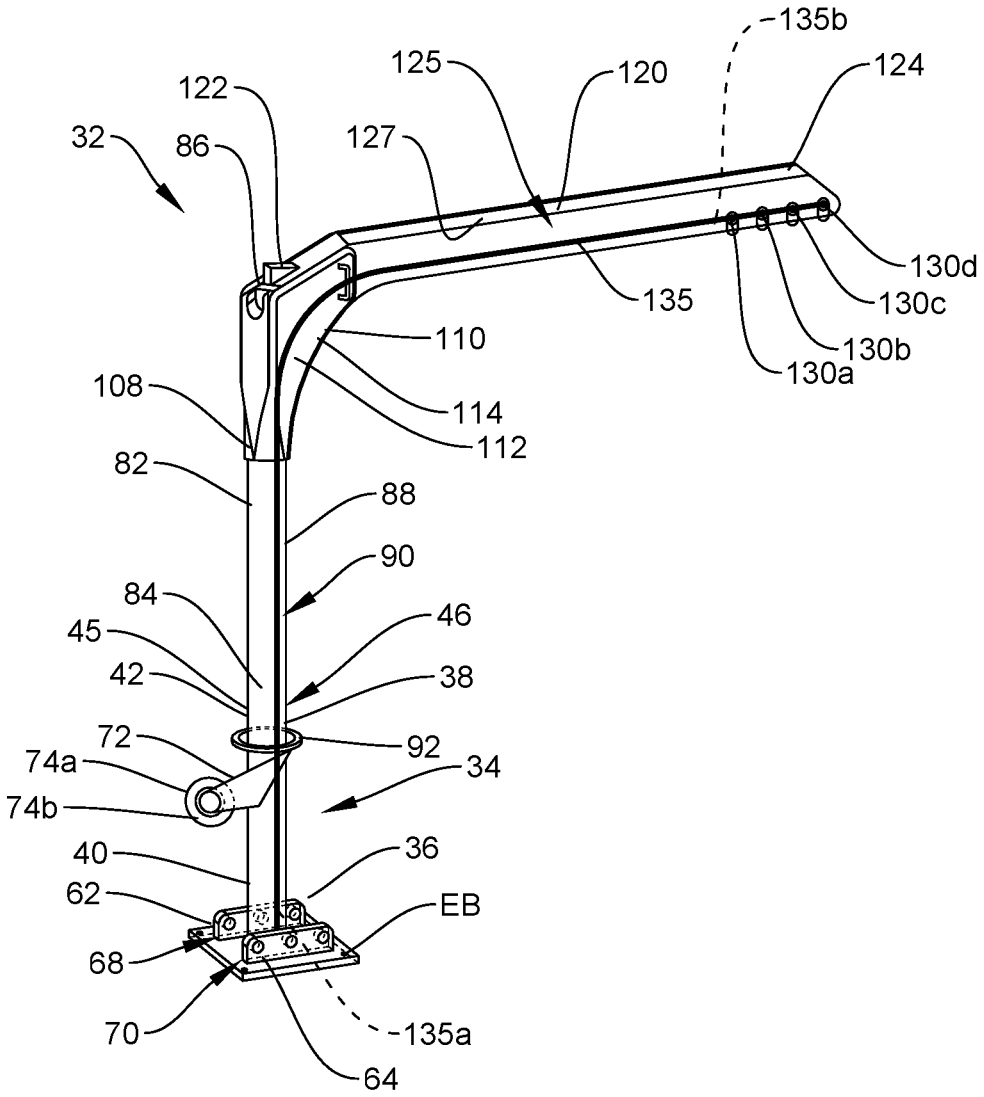
FIG. 7 is a perspective view, in part phantom, of components of the portable davit system shown in FIG. 1.
Figure 8:
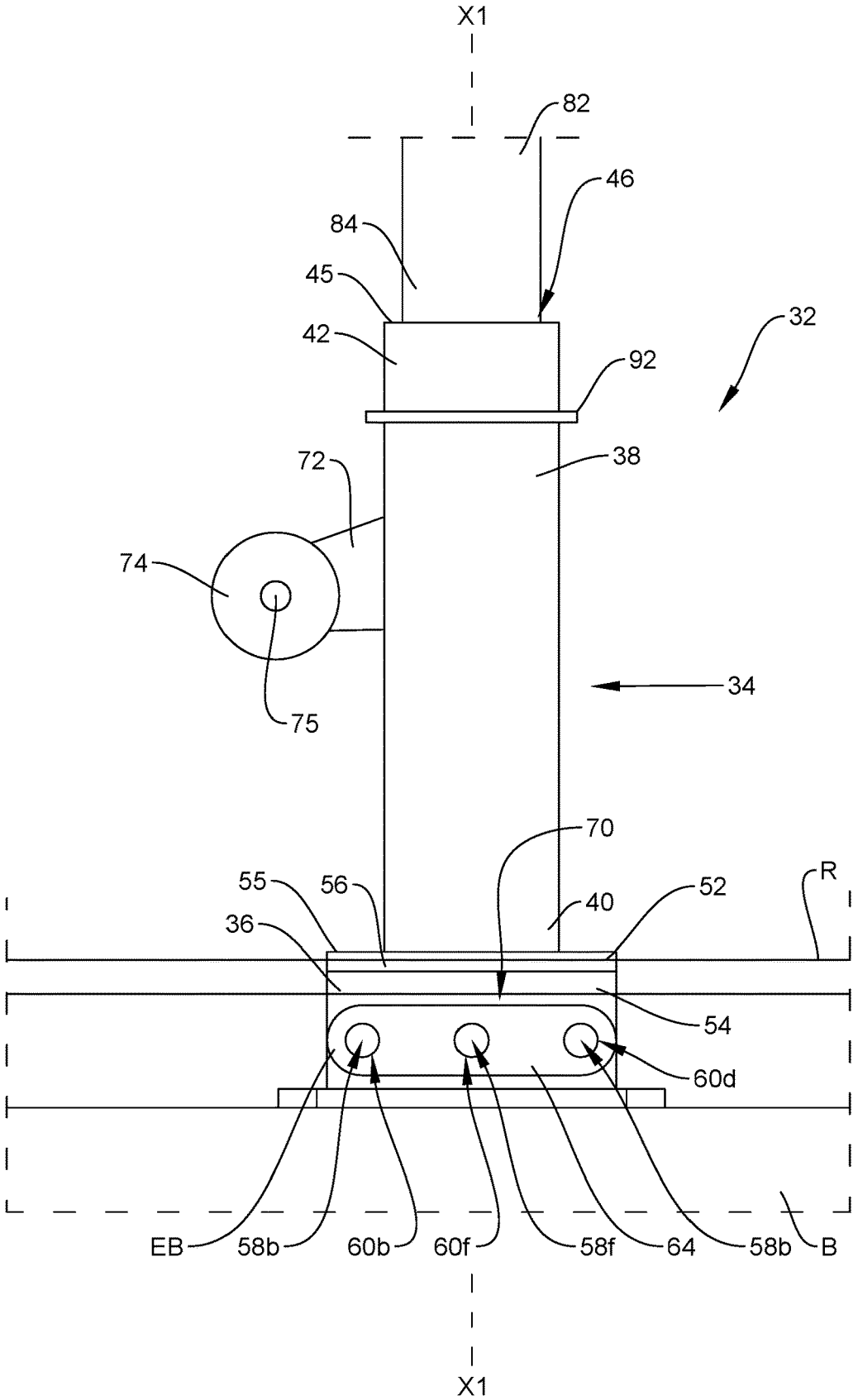
FIG. 8 is a side, breakaway view of components of the portable davit system shown in FIG. 1.

In one embodiment, shown in FIG. 7, davit 32 includes a steel wire rope, such as, for example, a rope 135 having an end 135*a* that is coupled directly to existing base EB and an opposite end 135*b* that is connected directly to one or more of connectors 130. Rope 135 is configured to prevent connectors 130 from moving relative to jib 120 and/or prevent connectors 130 from being disconnected from jib 120 when platform 138 is coupled to jib 120 by rope 134 or ropes 134*a*, 134*b*. In some embodiments, end 135*b* is connected to each of connectors 130*a*, 130*b*, 130*c*, 130*d*. In some embodiments, rope 135 is enclosed within passageway 90 and a channel 125 that is defined by an inner surface 127 of jib 120.

Figure 19:
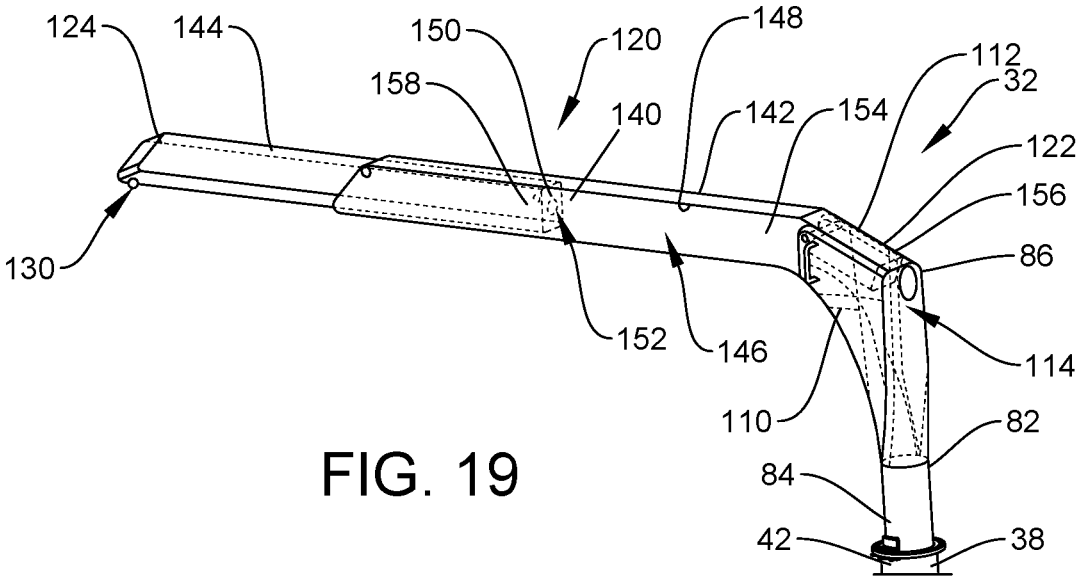
FIG. 19 is a perspective, breakaway view of components of the portable davit system shown in FIG. 1.

In some embodiments, jib 120 is telescopic and includes a screw system 140, as shown in FIG. 19, for example. Jib 120 is separated into an outer rail 142 and an inner rail 144. Inner rail 144 is movably positioned within a conduit 146 defined by an inner surface 148 of outer rail 142. An end surface of inner rail 144 includes a plate 150 positioned within conduit 146 such that plate 150 is movable relative to outer rail 142. Plate 150 is fixed to inner rail 144 and includes a threaded aperture 152. A threaded shaft 154 includes an end 156 that extends through an end surface of end 122 and an opposite end 158 that extends through aperture 152 such that a male thread form of shaft 154 matingly engages a female thread form of aperture 152. End 156 is accessible for rotation by hand or by a tool. In one embodiment, shown in FIG. 28, end 156 has a handle 175 configured to be gripped by hand to rotate end 156. Rotation of shaft 154 in a first rotational direction causes plate 150 to move away from end 122 to increase the length of jib 120 along axis X3 and rotation of shaft 154 in an opposite second rotational direction causes plate 150 to move toward end 120 along axis X3 to decrease the length of jib 120.

Figure 20:
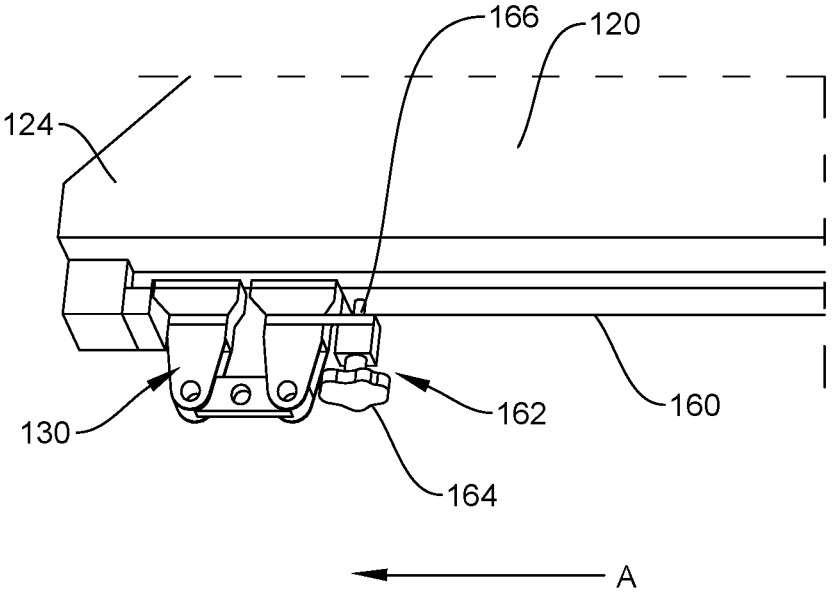
FIG. 20 is a perspective, breakaway view of components of the portable davit system shown in FIG. 1.
Figure 21:
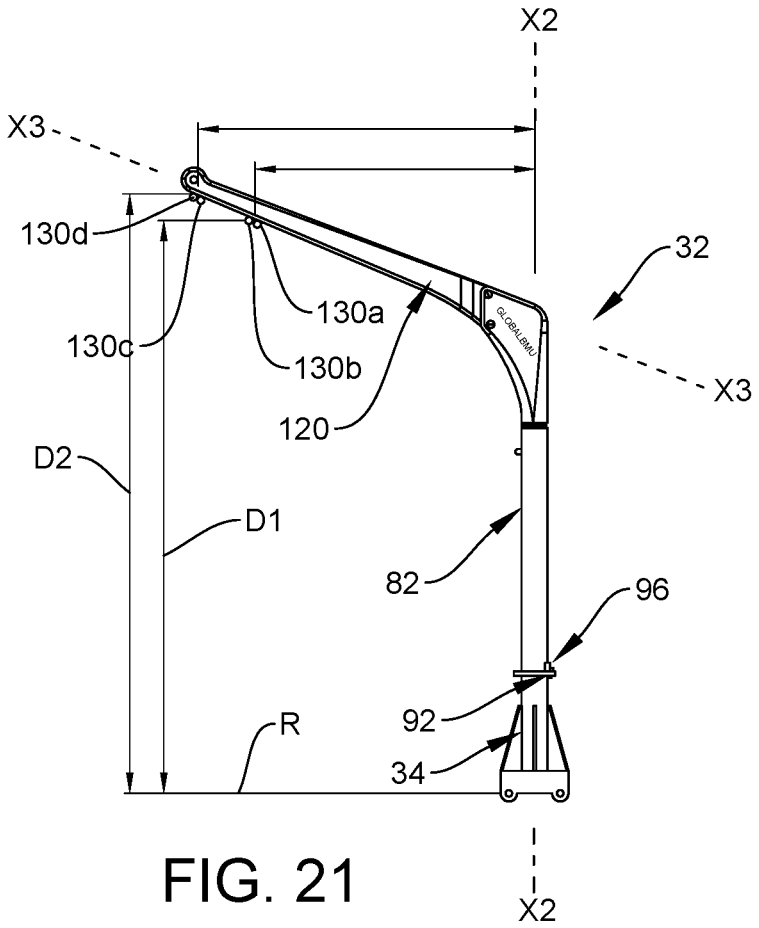
FIG. 21 is a side view of one embodiment of a portable davit system, in accordance with the principles of the present disclosure.
Figure 22:
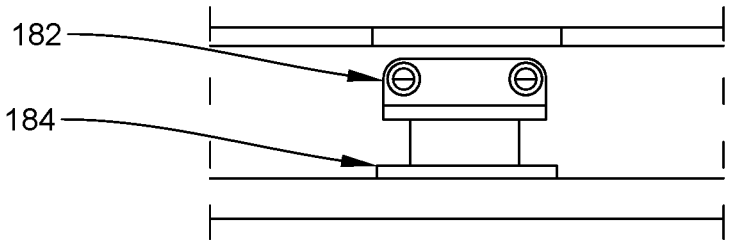
FIG. 22 is a side view of components of the portable davit system shown in FIG. 21.

In some embodiments, as shown in FIG. 20, jib 120 defines a track 160 that extends along axis X3. A portion of connector 130 is positioned within track 160 such that connector 130 is movable relative to jib 120 along axis X3 in opposite directions to selectively position connector 130 along a length of jib 120. In some embodiments, a brake 162 includes a knob 164 and a shaft 166 that is coupled to knob 164. Shaft 166 extends through connector 130 such that shaft 166 is rotatable relative to connector 130. In particular, knob 164 can be used to rotate shaft 166 relative to connector 130 and jib 120 in a first rotational direction to move shaft 166 such that shaft 166 directly engages jib 120 to prevent connector 130 from moving relative to jib 120 and to rotate shaft 166 relative to connector 130 and jib 120 in an opposite rotational direction to move shaft 166 such that shaft 166 is spaced apart from jib 120 to allow connector 130 to move relative to jib 120 along axis X3 in opposite directions. In the embodiment shown in FIG. 20, connector 130 includes an aperture 168 configured for disposal of rope 134*a* and an aperture 170 that is spaced apart from aperture 168 and configured for disposal of rope 134*b*. In some embodiments, a stopper 165 is coupled to jib 120 to prevent connector 130 from moving out of track 160 as connector 130 moves relative to jib 120 along axis X3 in the direction shown by arrow A in FIG. 20.

Platform 138 includes a frame 172 and a hoist 174 that is coupled to frame 172. Hoist 174 is configured to raise and lower platform 138 relative to roof R. That is, hoist 174 includes a winch configured to rotate in a first rotational direction to wind rope 134 or ropes 134*a*, 134*b* about the winch to move platform 138 closer to roof R and to rotate in an opposite second rotational direction to unwind rope 134 or ropes 134*a*, 134*b* from the winch to move platform 138 further away from roof R. In some embodiments, hoist 174 is coupled to an end 176 of frame 172 and frame 172 includes an opposite end 178 having a hoist 180 couple thereto such that hoist 180 is spaced apart from hoist 174.

In some embodiments, portable davit system 30 includes a davit, such as, for example, a second davit 232 that is the same or similar to davit 32. That is, davit 232 includes identical components as davit 32 and is assembled, unassembled and moved from location to location in same way that davit 32 is assembled, unassembled and moved from location to location. Davit 232 is configured to be coupled to hoist 180 to assist in raising a lower platform 138 relative to roof R, as discussed herein. Davit 232 includes a base 234 that is the same or similar to base 34. Base comprises a mounting portion 236 that is the same or similar to mounting portion 36 and a housing 238 that is the same or similar to housing 38 coupled to mounting portion 236. Mounting portion 236 is configured to be coupled to an existing bracket of a building, such as, for example, an existing bracket EB1 on roof R of a building B to couple davit 232 to building B, as discussed herein.

Housing 238 is coupled directly to mounting portion 236. An inner surface of housing 238 defines a cavity that is the same or similar to cavity 46. Base 234 includes a bracket 272 that is the same or similar bracket 72. Bracket 272 that is coupled to housing 238 and one or a plurality of wheels, such as, for example, transport wheels 274 that are the same or similar to wheels 74 are rotatably coupled to bracket 272. Wheels 274 are configured to support base 234 while davit 232 is being assembled and unassembled and/or when davit 232 is being moved from one location to another location, such as, for example, one location on roof R to another location on roof R. For example, in one embodiment, base 234 can be connected with existing bracket EB1 by tilting base 234 such that the majority of the weight of davit 232 is carried by wheels 274. Wheels 274 rotate relative to bracket 272 to translate base 234 along roof R and position mounting portion 236 adjacent to existing base EB1 such that flanges of mounting portion 236 are positioned within channels of existing base EB1. A first peg is inserted through a first aperture of one of the flanges of mounting portion 236 and a first hole in one of the flanges of existing base EB1. A second peg is inserted through a first aperture of the other flange of mounting portion 236 and a first hole in the other flange of existing base EB1.

Base 234 is then tilted relative to existing bracket EB1 such that base 234 extends perpendicular to roof R and second and third apertures of one of the flanges of mounting portion 236 are aligned with second and third holes in one of the flanges of existing base EB1 and second and apertures of the other the flange of mounting portion 236 are aligned with second and third holes in the other flange of existing base EB1. A third peg is inserted into one of the second and third apertures of one of the flanges of mounting portion 236 and one of the second and third holes of one of the flanges of existing base EB1. A fourth peg is inserted into one of the second and third apertures of the other flange of mounting portion 236 and one of the second and third holes of the other flange of existing base EB1.

In one embodiment, base 234 can be disconnected from existing bracket EB1 by removing the third and fourth pegs from the flanges of mounting portion 236 and the flanges of existing base EB1. Base 234 is then rotated relative to existing bracket EB1 about the first and second pegs such that base 234 extends at acute angle relative to roof R. The remaining pins are removed from the flanges of mounting portion 236 and the flanges of existing base EB1 such that base 234 can be lifted out of existing bracket EB1. Base 234 can then be translated along roof R using wheels 274 to move base from existing bracket EB1 to another location on roof R, such as, for example, another existing base that is the same or similar to existing bracket EB1.

Davit 232 includes a mast 282 that is the same or similar to mast 82. An end of mast 282 is configured to be positioned in the cavity defined by the inner surface of housing 238 such that mast 282 is rotatable relative to base 234. Mast 282 comprises spaced apart walls 310, 312 that define a cavity 314 therebetween. Wall 310 includes an aperture that is the same or similar to aperture 116 and wall 312 includes an aperture that is the same or similar to aperture 118 that is aligned with the aperture of wall 310. Davit 232 includes a jib 320 having a first end that is pivotably positioned within cavity 314. In some embodiments, all or a portion of mast 282 and/or jib 320 is made from a strong, lightweight material, such as, for example, carbon fiber. That is, all or a portion of mast 282 and/or jib 320 consists of and/or comprises a strong, lightweight material, such as, for example, carbon fiber.

The first end of jib 320 includes a pathway that extends through a thickness of the first end jib 320 and is aligned with the apertures of walls 310, 312. In some embodiments, a dowel that is the same or similar to dowel 126 extends simultaneously through the pathway in the first end of jib 320 and the apertures of walls 310, 312 to connect jib 320 to mast 282. The dowel defines a hinge configured to allow jib 320 to pivot relative to mast 282 to move jib 320 between a first orientation in which jib 320 extends transverse and/or perpendicular to mast 282 to a second orientation in which jib 320 extends parallel to mast 282.

In some embodiments, davit 232 includes one or a plurality of connectors 330 that are each the same or similar to connectors 130 and are coupled directly to jib 320. An end 332 of a cable, such as, for example, a rope 334 that is the same or similar to rope 134 is coupled to one of connectors 330 and an opposite end 336 of rope 334 is coupled to platform 138, as discussed herein. In some embodiments, rope 334 includes two ropes 334, such as, for example, a rope 334*a* and a rope 334*b*. Ends 332 of ropes 334*a*, 334*b* are each coupled to one of connectors 330 and ends 336 of ropes 334*a*, 334*b* are each coupled to platform 138. In some embodiments, connectors 330 are eyelets. In some embodiments, connectors 330 are fixed relative to jib 320 such that connectors 330 are prevented from moving relative to jib 320.

In some embodiments, jib 320 is telescopic and includes a screw system that is the same or similar to screw system 140. In some embodiments, jib 320 defines a track that is the same or similar to track 160. A portion of connector 330 is positioned within the track such that connector 330 is movable relative to jib 320 in opposite directions to selectively position connector 330 along a length of jib 320. In some embodiments, davit 232 includes a brake that is the same or similar to brake 162, a knob that is the same or similar knob 164 and a shaft that is the same or similar to knob 166. The knob can be used to rotate the shaft relative to connector 330 and jib 320 in a first rotational direction to move the shaft such that the shaft directly engages jib 320 to prevent connector 330 from moving relative to jib 320 and to rotate the shaft relative to connector 330 and jib 320 in an opposite rotational direction to move the shaft such that the shaft is spaced apart from jib 320 to allow connector 330 to move relative to jib 320 opposite directions.

End 336 and/or ends 336*a*, 336*b* are coupled to hoist 180. Hoist 180 is configured to work in conjunction with hoist 174 to raise and lower platform 138 relative to roof R. That is, hoist 180 includes a winch configured to rotate in a first rotational direction to wind rope 334 or ropes 334*a*, 334*b* about the winch to move platform 138 closer to roof R and to rotate in an opposite second rotational direction to unwind rope 334 or ropes 334*a*, 334*b* from the winch to move platform 138 further away from roof R.

Figure 10:
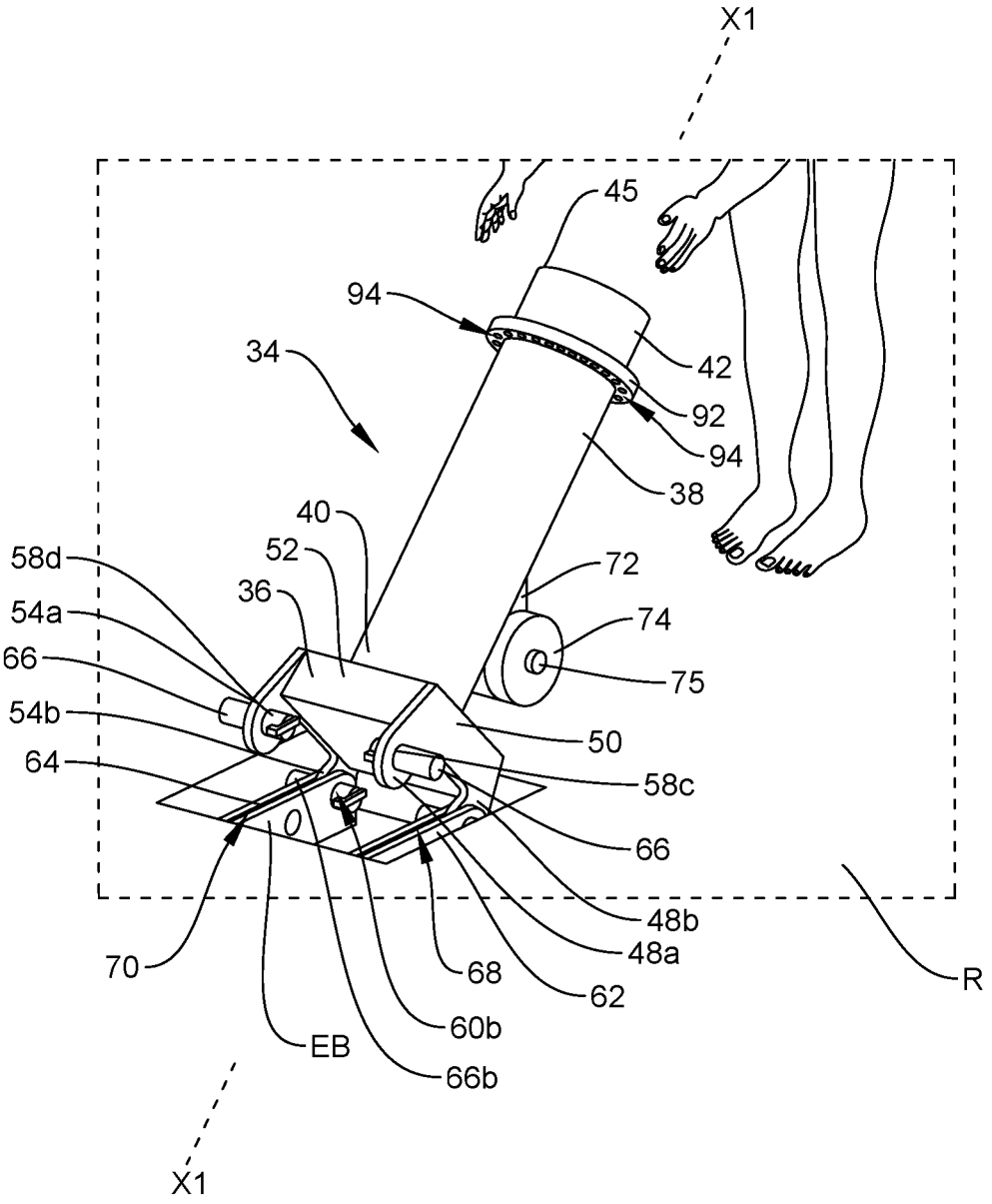
FIG. 10 is a perspective view of components of the portable davit system shown in FIG. 1.
Figure 11:
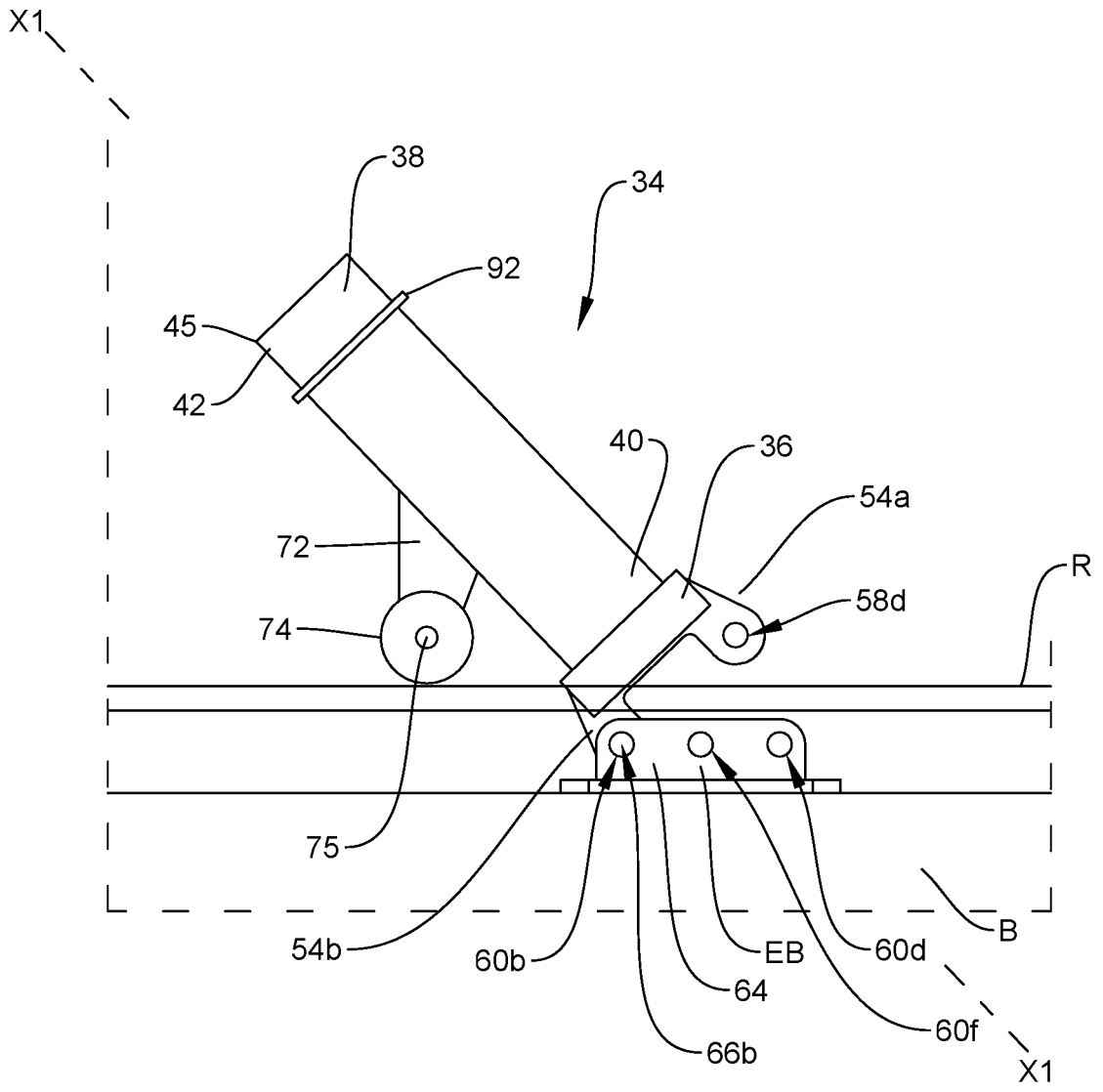
FIG. 11 is a side view of components of the portable davit system shown in FIG. 1.

As discussed above, in some embodiments, davit 32 is identical to davit 232, and vice versa, such that davit 32 is assembled and connected with existing base EB in the same manner as davit 232 is assembled and connected with existing base EB1. To connect davit 32 with existing base EB, base 34 is tilted relative to a surface, such as, for example, roof R such that axis X1 extends transverse to roof R and wheels 74 directly engage roof R. Base 34 is then moved along roof R using wheels 74 to move base 34 to a selected location of roof R, such as, for example, to existing base EB. An end of flange 48 or flange 48*b* is inserted into channel 68 such that an aperture 58 of flange 48 or flange 48*b*, such as, for example, aperture 58*a* is aligned with a hole 60 of flange 62, such as, for example, hole 60*a*. An end of flange 54 or flange 54*b* is inserted into channel 70 such that an aperture 58 of flange 48 or flange 48*b*, such as, for example, aperture 58*b* is aligned with a hole 60 of flange 64, such as, for example, hole 60*b*. A peg 66, such as, for example, peg 66*a* is inserted through aperture 58*a* and hole 60*a* and a peg 66, such as, for example, peg 66*b* is inserted through aperture 58*b* and hole 60*b* with axis X1 extending transverse to roof R, as shown in FIGS. 10 and 11.

Figure 14:
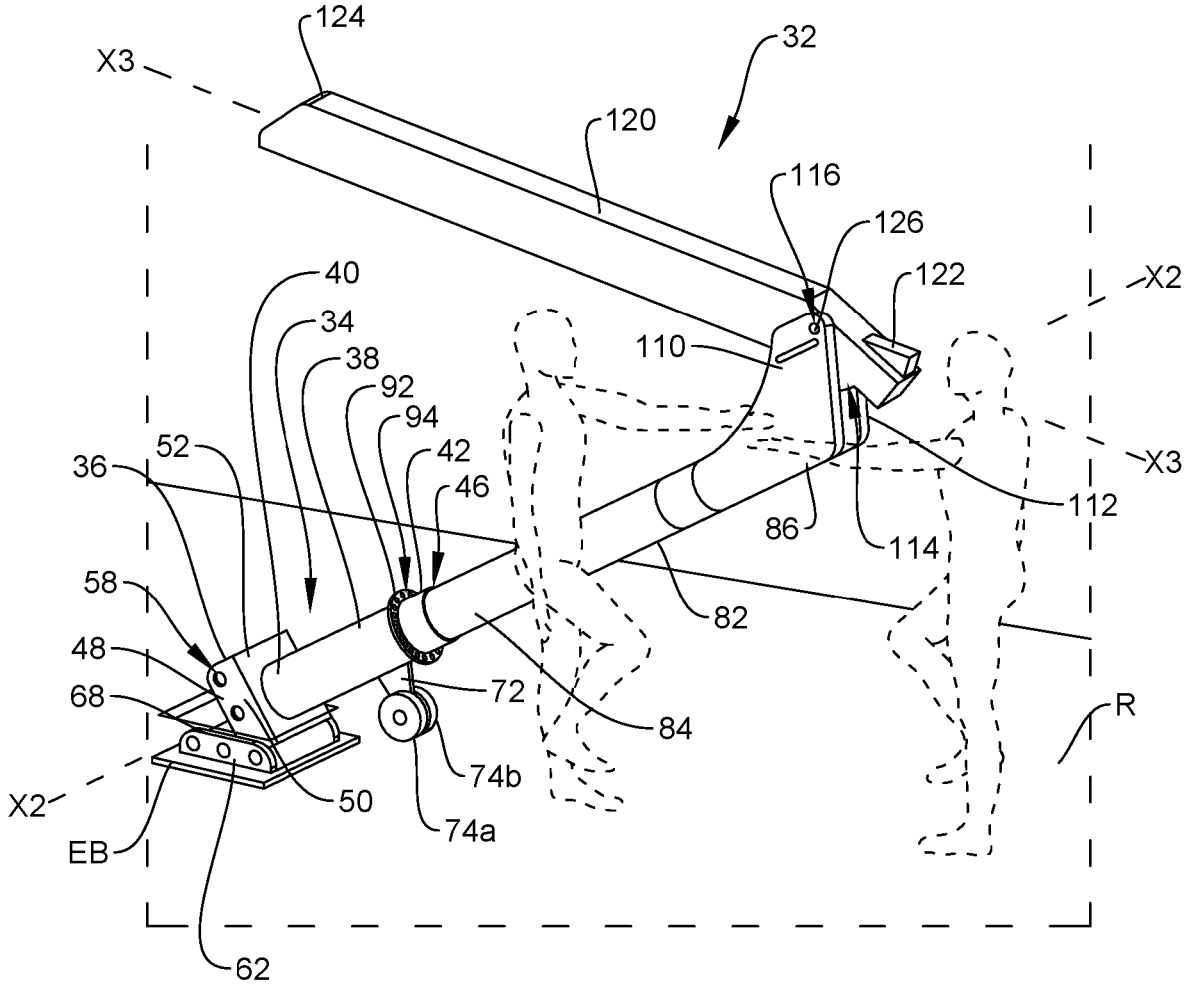
FIG. 14 is a perspective view of components of the portable davit system shown in FIG. 1.
Figure 15:
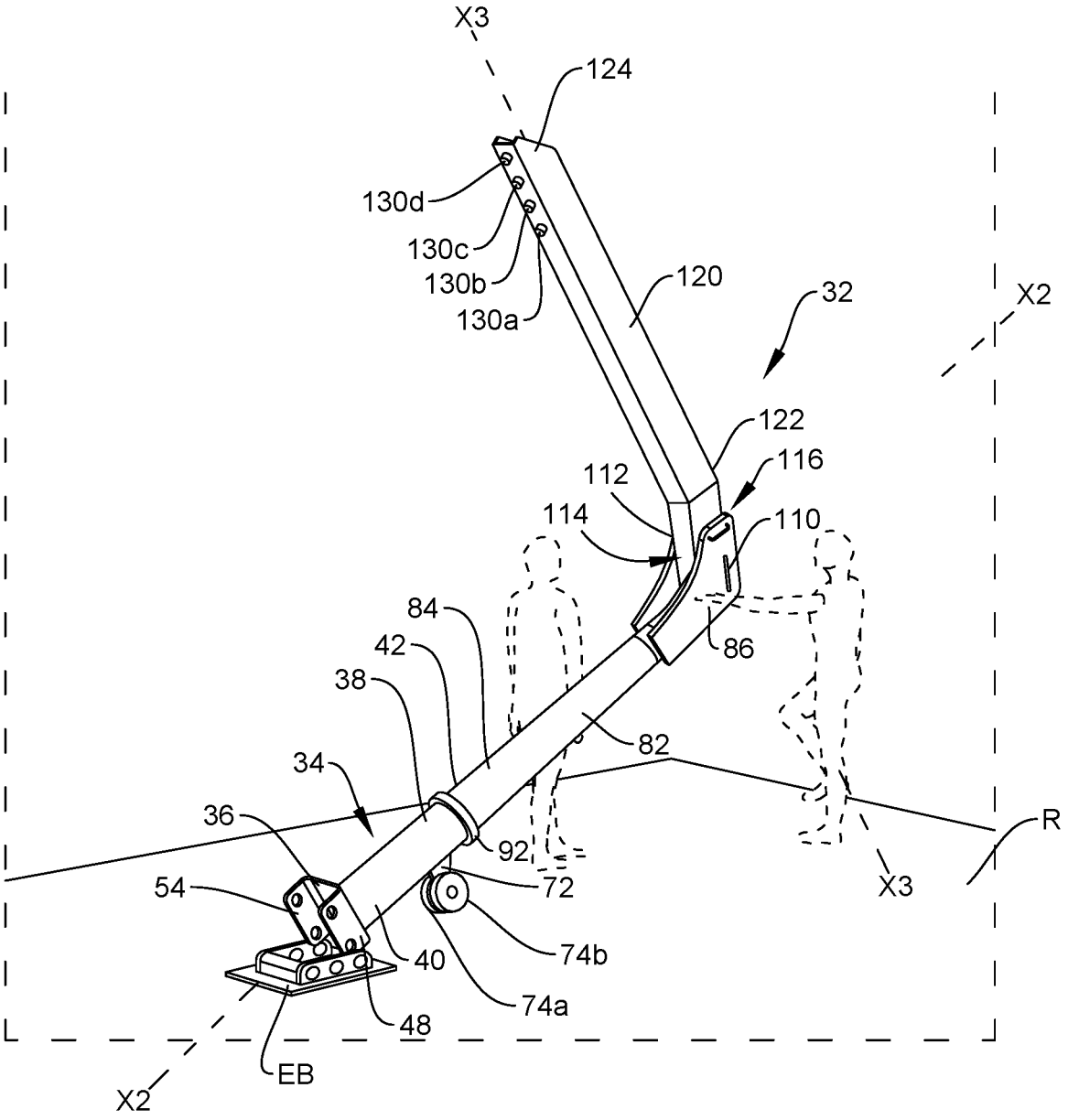
FIG. 15 is a perspective view of components of the portable davit system shown in FIG. 1.

End 84 of mast 82 is aligned with cavity 46, with jib 120 coupled to mast 82 such that axis X2 extends parallel to axis X3, as shown in FIGS. 12 and 13. End 84 of mast 82 is then inserted into cavity 46 to couple mast 82 and jib 120 with base 34 and jib 120 is pivoted relative to mast 82 about dowel 126 such that axis X2 extends transverse to axis X3, as shown in FIG. 14. Jib 120 is further pivoted relative to mast 82 about dowel 126 such that axis X2 extends perpendicular to axis X3, as shown in FIG. 15. Base 34 is tilted relative to roof R such that axis X1 extends perpendicular to roof R and wheels 74 are spaced apart from roof R, as shown in FIG. 16. An end of flange 48 or flange 48*a* is inserted into channel 68 such that an aperture 58 of flange 48 or flange 48*a*, such as, for example, aperture 58*c* is aligned with a hole 60 of flange 62, such as, for example, hole 60*c*. An end of flange 54 or flange 54*a* is inserted into channel 70 such that an aperture 58 of flange 48 or flange 48*b*, such as, for example, aperture 58*d* is aligned with a hole 60 of flange 64, such as, for example, hole 60*d*. A peg 66, such as, for example, peg 66*c* is inserted through aperture 58*c* and hole 60*c* and a peg 66, such as, for example, peg 66*d* is inserted through aperture 58*d* and hole 60*d*. In some embodiments, an aperture 58 of flange 48 or flange 48*a*, such as, for example, aperture 58*e* is aligned with a hole 60 of flange 62, such as, for example, hole 60*e* and an aperture 58 of flange 48 or flange 48*b*, such as, for example, aperture 58*f* is aligned with a hole 60 of flange 64, such as, for example, hole 60*f*. A peg inserted through aperture 58*e* and hole 60*e* and a peg is inserted through aperture 58*f* and hole 60*f*. End 132 of rope 134 or ends 132 of ropes 134*a*, 134*a* are coupled to one of connectors 130 such that rope 134 connects davit 32 with platform 138.

In some embodiments, mast 82 is selectively rotated relative to base 34 about axes X1, X2 and a first one of holes 102 is aligned with first one of holes 94 and a second one of holes 94 is aligned with a second one of holes 102. A first plug 104 is inserted simultaneously through the first one of holes 94 and the first one of holes 102 and a second plug 104 is inserted simultaneously through the second one of holes 94 and the second one of holes 102 to prevent rotation of mast 82 relative to base 34 about axes X1, X2

In some embodiments, end 156 of shaft 154 is rotated in a first rotational direction such that plate 150 moves away from end 122 to increase the length of jib 120 along axis X3. In some embodiments, end 156 of shaft 154 is rotated in an opposite second rotational direction such that plate 150 moves toward end 120 along axis X3 to decrease the length of jib 120.

In some embodiments, connector 130 is translated along track 160 to position connector 130 at a selected position along track 160. Knob 164 is rotated to rotate shaft 166 relative to connector 130 and jib 120 in a first rotational direction to move shaft 166 such that shaft 166 directly engages jib 120 to fix connector 130 at the selected position along track 160.

In operation and use, the winches of hoists 174, 180 simultaneously rotate in a first rotational direction to wind ropes 134, 334 or ropes 134*a*, 134*b*, 334*a*, 334*b* about the winches to move platform 138 closer to roof R and/or to rotate simultaneously rotate in an opposite second rotational direction to unwind ropes 134, 334 or ropes 134*a*, 134*b*, 334*a*, 334*b* from the winches to move platform 138 further away roof R.

As discussed above, in some embodiments, davit 32 is identical to davit 232, and vice versa, such that davit 32 is disassembled and disconnected from existing base EB in the same manner as davit 232 is disassembled and disconnected from existing base EB1. To disconnect davit 32 from existing base EB with davit 32 in the orientation shown in FIG. 16, end 132 of rope 134 or ends 132 of ropes 134*a*, 134*a* are uncoupled from one of connectors 130 to disconnect rope 134 from davit 32. Next, peg 66*c* is removed from aperture 58*c* and hole 60*c* and peg 66*d* is removed from aperture 58*d* and hole 60*d*. In some embodiments, a peg is removed from aperture 58*e* and hole 60*e* and a peg is removed from aperture 58*f* and hole 60*f*. Davit 32 is then tilted relative to roof R such that axis X1 extends transverse to roof R and wheels 74 directly engage roof R to support the weight of davit 32. Axis X2 extends parallel to axis X1 and axis X3 extends perpendicular to axes X1, X2, as shown in FIG. 15.

Jib 120 is pivoted relative to mast 82 about dowel 126 such that axis X2 extends transverse to axis X3, as shown in FIG. 14. Jib 120 is further pivoted relative to mast 82 about dowel 126 such that axis X2 extends parallel to axis X3, as shown in FIG. 13. End 84 of mast 82 is then removed from cavity 46 to separate mast 82 and jib 120 from base 34, as shown in FIG. 12. At this time, mast 82 and jib 120 can remain connected to one another with axis X2 extending parallel to axis X3 and the assembly of mast 82 and jib 120 can be transported to another location on roof R, another location on building B, or to a different building. Peg 66*a* is removed from aperture 58*a* and hole 60*a* and peg 66*b* is removed from aperture 58*b* and hole 60*b*. Mounting portion 36 can then be moved relative to existing bracket EB such that base 34 can be transported to the location that the assembly of mast 82 and jib 120 was previously transported to. Davit 32 can then be connected with another bracket that is the same or similar to existing bracket EB and assembled in a manner that is the same or similar to that discussed above with regard to existing bracket EB.

Figure 23:
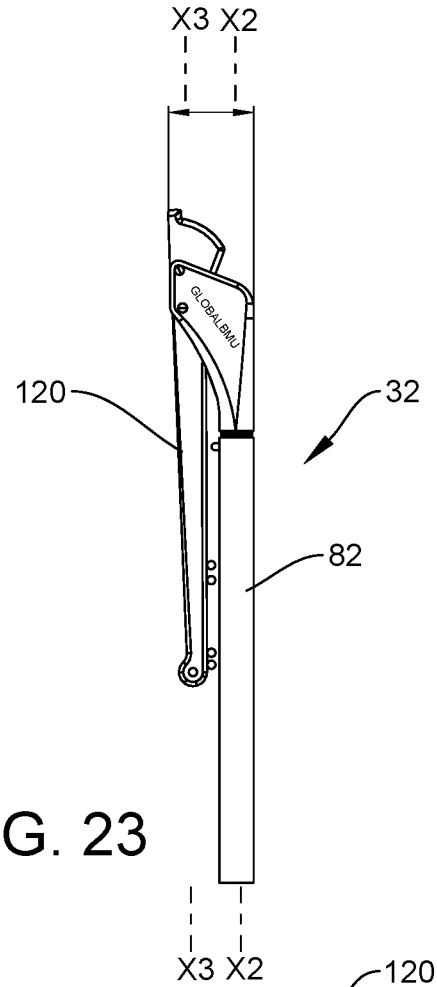
FIG. 23 is a side view of components of the portable davit system shown in FIG. 21.
Figure 24:
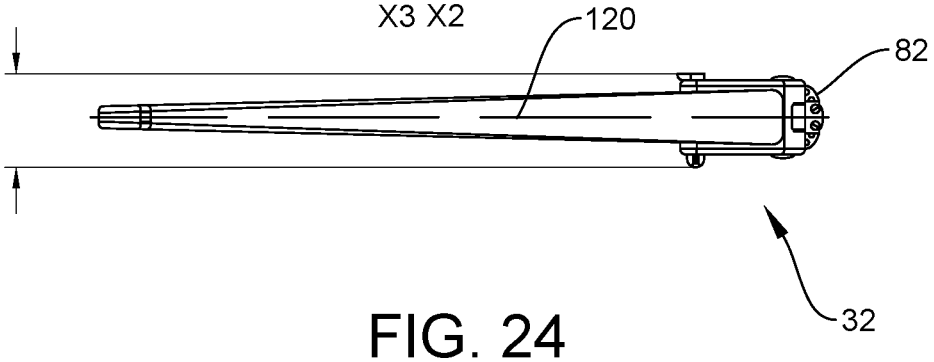
FIG. 24 is a top view of components of the portable davit system shown in FIG. 21.
Figure 25:
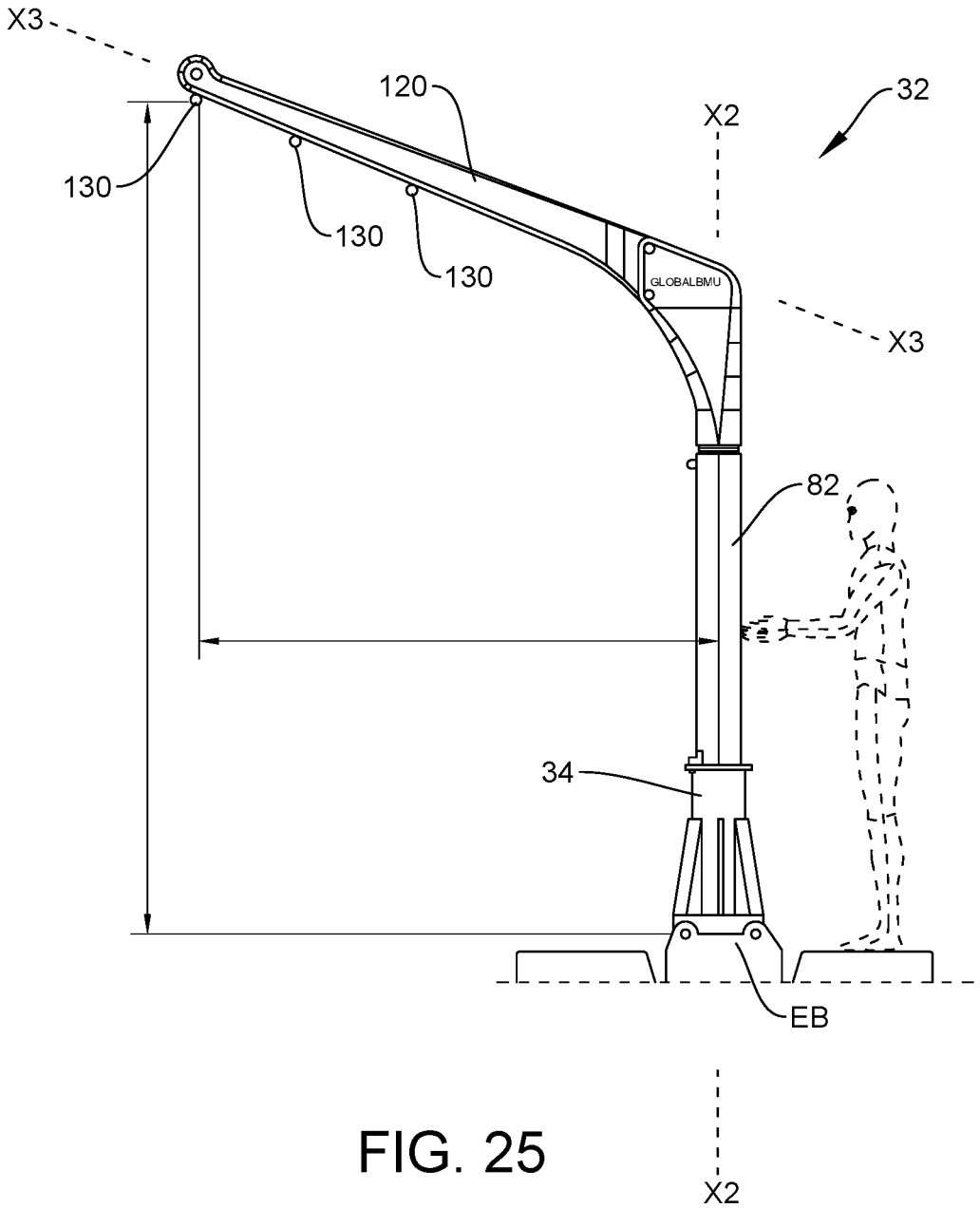
FIG. 25 is a perspective view of components of the portable davit system shown in FIG. 21.

In one embodiment, shown in FIGS. 21-25, jib 120 extends transverse to mast 82 when davit 32 is fully assembled. That is, axis X3 extends transverse to axis X2 when davit 32 is fully assembled. In some embodiments, axis X3 extends at an angle between about 10 degrees and about 60 degrees relative to axis X2 when davit 32 is fully assembled. In some embodiments, axis X3 extends at an angle between about 20 degrees and about 50 degrees relative to axis X2 when davit 32 is fully assembled. In some embodiments, axis X3 extends at an angle of about 45 degrees relative to axis X2 when davit 32 is fully assembled. Angling axis X3 relative to axis X2 positions connectors 130 at different distances from roof R. For example, connector 130*b* is spaced apart a distance D1 from roof R and connector 130*d* is spaced apart a distance D2 from roof R that is greater than distance D1. Connector 130*a* is spaced apart a distance from roof R that is less than distance D1. Connector 130*d* is spaced apart a distance from roof R that is greater than distance D2. As shown in FIG. 23, jib 120 of davit 32 in FIG. 21 can be folded relative to mast 82 such that axis X2 extends parallel to axis X3. In one embodiment, shown in FIG. 22, davit 32 includes an under paver pedestal 182 that is configured to engage a building connection 184 to connect davit with building B.

Figure 26:
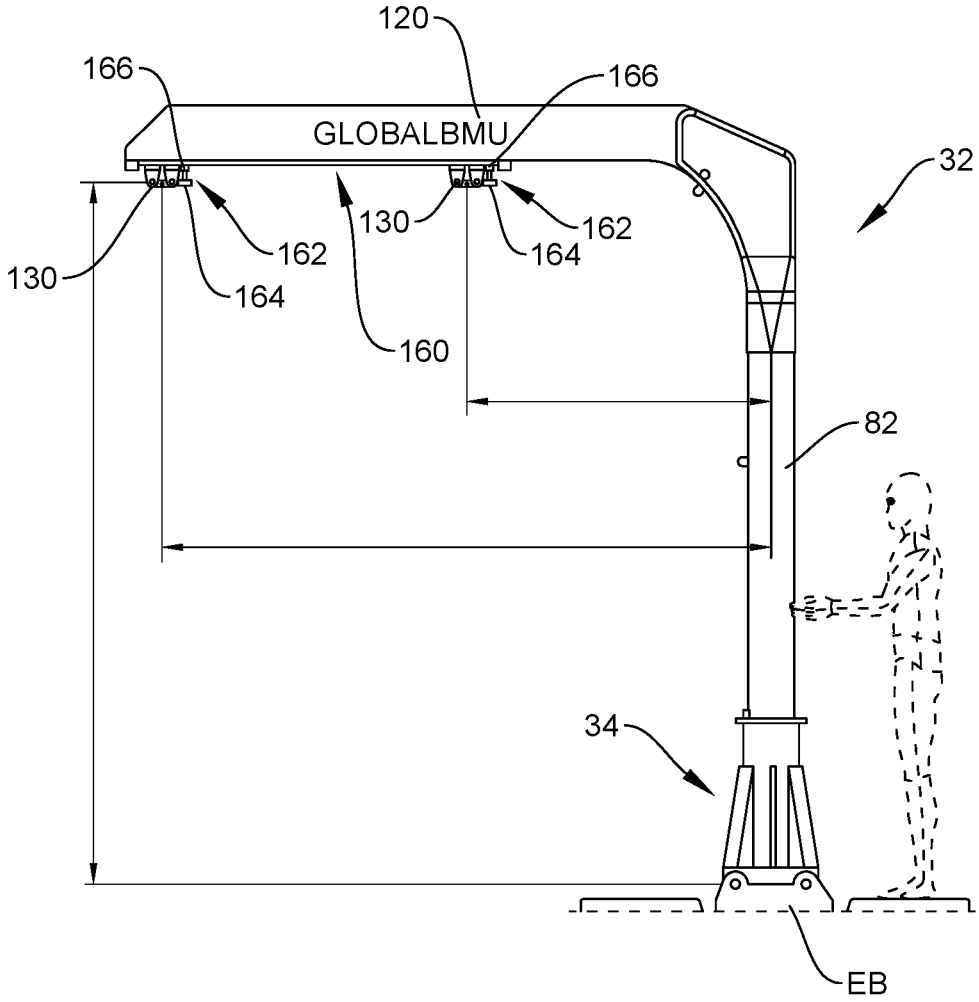
FIG. 26 is a side view of one embodiment of a portable davit system, in accordance with the principles of the present disclosure.
Figure 27:
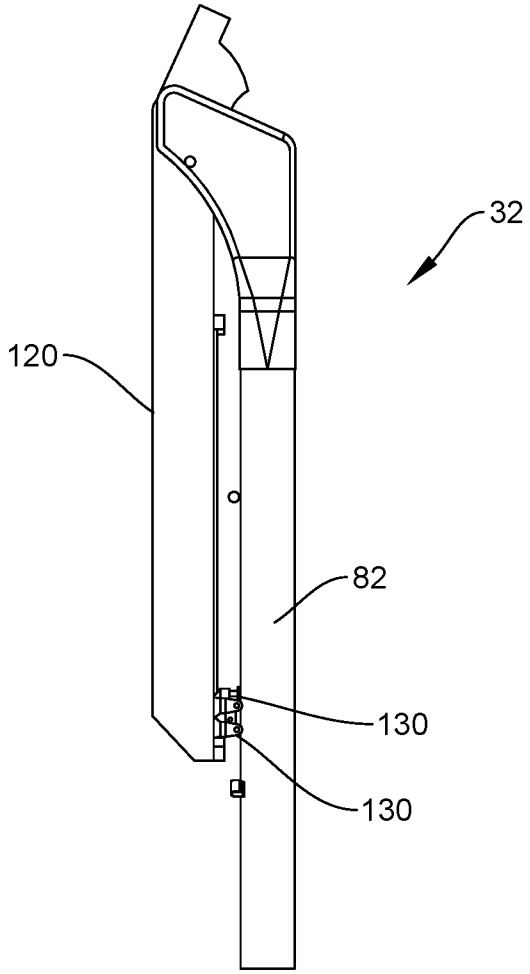
FIG. 27 is a side view of components of the portable davit system shown in FIG. 26.
Figure 28:
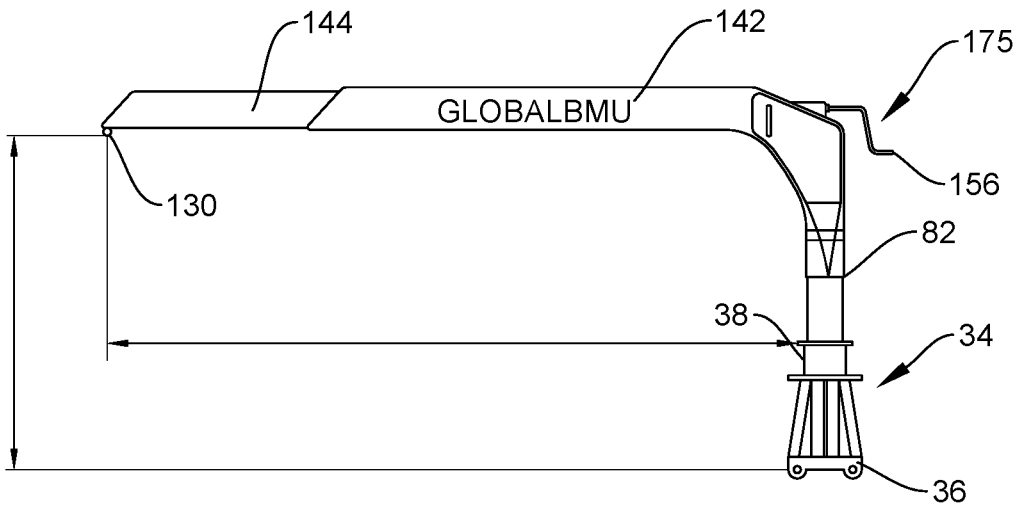
FIG. 28 is a side view of one embodiment of a portable davit system, in accordance with the principles of the present disclosure.

In some embodiments, as shown in FIGS. 26 and 27, track 160 includes two spaced apart connectors 130 positioned within track 160. In some embodiments, each of the connectors 130 shown in FIG. 26 are the same or similar to connector 130 shown in FIG. 20. This allows one rope or set of ropes or cables, such as, for example, rope 134 or ropes 134*a*, 134*b* to be coupled to one of connectors 130 and another rope or set or ropes or cables to be coupled to the other one of connectors 130. For example, when it is desired to position platform 138 closer to mast 82 or building B, a rope or set of ropes or cables, such as, for example, rope 134 or ropes 134*a*, 134*b* can be coupled to the connector 130 that is closer to mast 82. Likewise, when it is desired to position platform 138 further away from mast 82 or building B, a rope or set of ropes or cables, such as, for example, rope 134 or ropes 134*a*, 134*b* can be coupled to the connector 130 that farther away from mast 82. As shown in FIG. 27, connectors 130 are independently movable relative to one another to selectively position each of connectors 130 along track 160.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A portable davit consisting of:

a monolithic mounting portion configured to be coupled to a davit base of a building to mount the portable davit to the building;

a base extending along a longitudinal axis between opposite proximal and distal ends, the distal end being coupled to the mounting portion, the base consisting of an inner surface, an opposite outer surface that extends parallel to the longitudinal axis, a bracket coupled directly to the outer surface and a transport wheel coupled to the bracket, the inner surface and a top surface of the base defining a cavity;

a mast consisting of opposite first and second ends, the first end of the mast being positioned within the cavity;

a jib consisting of opposite first and second ends and a track, the first end of the jib being coupled to the second end of the mast, the jib being pivotable relative to the mast to move the second end of the jib toward the base;

a connector coupled to the jib;

a platform; and a hoist coupled to the platform, the hoist consisting of a drive and a rope, the rope including first and second ends, the first end of the rope being wound about the drive, the second end of the rope being coupled to the connector, wherein the drive is configured to rotate relative to the platform in a first direction to decrease a distance between the platform and the second end of the jib and to rotate relative to the platform in an opposite second direction to increase the distance between the platform and the second end of the jib.

2. The portable davit recited in claim 1, wherein the mast and the jib are made from carbon fiber.

3. The portable davit recited in claim 1, wherein the jib has a length defined by a distance from the first end of the jib to the second end of the jib, the connector being movable relative to the jib along the length of the jib.

4. The portable davit recited in claim 1, wherein the connector is positioned within the track such that the connector is movable along the track.

5. The portable davit recited in claim 1, wherein the connector is permanently fixed the jib.

6. The portable davit recited in claim 1, wherein the jib is telescopic.

7. The portable davit recited in claim 1, wherein the jib has a length defined by a distance from the first end of the jib to the second end of the jib, the jib being configured to increase and decrease the length of the jib.

8. The portable davit recited in claim 1, wherein the jib is pivotable relative to the mast between a first orientation in which the connector is spaced apart from the mast and a second orientation in which the connector directly engages the mast.

9. The portable davit recited in claim 1, wherein the jib is pivotable relative to the mast between a first orientation in which the jib extends transverse to mast and a second orientation in which the jib extends parallel to the mast.

10. The portable davit recited in claim 9, wherein the portable davit is configured to maintain the mast in the first orientation.

11. The portable davit recited in claim 1, wherein the mast is rotatable relative to the base about the longitudinal axis.

12. The portable davit recited in claim 1, wherein the bracket is positioned along the housing between the top surface and the mast.

13. A portable davit comprising consisting of:

a monolithic mounting portion configured to mount the portable davit to a davit base, the davit base being coupled to a building, the mounting portion consisting of a plate, spaced apart flanges extending distally from the plate and a top portion, end surfaces of the flanges defining distalmost surfaces of the mounting portion, the davit base consisting of a planar platform and spaced apart flanges extending proximally from a top surface of the platform, the flanges of the mounting portion engaging the flanges of the davit base to align apertures of the flanges of the mounting portion with holes in the flanges of the davit base;

a base extending along a longitudinal axis between opposite proximal and distal ends, the distal end being coupled to the mounting portion, the base consisting of the proximal and distal ends, an inner surface, an opposite outer surface that extends parallel to the longitudinal axis, a bracket and a transport wheel, the inner surface and the top surface mounting portion defining a cavity, the bracket being coupled directly to the outer surface, the transport wheel being coupled to the bracket, the bracket and the transport wheel each being spaced apart from the mounting portion;

a mast consisting of opposite first and second ends, the first end of the mast being positioned within the cavity, the mast being made from carbon fiber, the mast being rotatable relative to the base about the longitudinal axis;

a jib consisting of opposite first and second ends and a track, the first end of the jib being coupled to the second end of the mast, the jib being made from carbon fiber, the track extending from the first end of the jib to the second end of the jib, the jib being pivotable relative to the mast to move the second end of the jib toward the base such that the jib pivots relative to the mast from a first orientation in which the jib extends transverse to mast to a second orientation in which the jib extends parallel to the mast;

a connector positioned within the track such that the connector is movable relative to the jib along the track;

a brake rotatably coupled to the connector and configured to prevent movement of the connector along the track;

a platform; and a hoist coupled to the platform, the hoist consisting of a drive and a rope, the rope including first and second ends, the first end of the rope being wound about the drive, the second end of the rope being coupled to the connector, wherein the drive is configured to rotate relative to the platform in a first direction to decrease a distance between the platform and the second end of the jib and to rotate relative to the platform in an opposite second direction to increase the distance between the platform and the second end of the jib.

14. A portable davit consisting of:

a first davit comprising:

a monolithic first mounting portion configured to be coupled to a davit base, the davit base being configured to be coupled to a building, the first mounting portion consisting of a plate, spaced apart flanges extending distally from the plate and a top surface, end surfaces of the flanges defining distalmost surfaces of the mounting portion, the davit base consisting of a planar platform and spaced apart flanges extending proximally from a top surface of the platform, the flanges of the mounting portion engaging the flanges of the davit base to align apertures of the flanges of the first mounting portion with holes in the flanges of the davit base;

a first base consisting of opposite proximal and distal ends, a first inner surface, an opposite first outer surface, a bracket and a transport wheel, the first base extending along a longitudinal axis between the proximal and distal ends, the distal end being coupled to the first mounting portion, the first inner surface and the first outer surface extending parallel to the longitudinal axis, the first inner surface and the top surface of the first base defining a first cavity, the bracket being coupled directly to the first outer surface and the transport wheel being coupled directly to the bracket, a first mast consisting of opposite first and second ends, the first end of the first mast being positioned within the first cavity, a first jib consisting of opposite first and second ends, the first end of the first jib being coupled to the second end of the first mast, the first jib being pivotable relative to the first mast to move the second end of the first jib toward the first base, a first connector coupled to the first jib, a platform, and a first hoist coupled to the platform, the first hoist consisting of a first drive and a first rope, the first rope including first and second ends, the first end of the first rope being wound about the first drive, the second end of the first rope being coupled to the first connector; and a second davit comprising:

a second base comprising a second mounting portion coupled to the second base, the second base comprising a second inner surface defining a second cavity, a second mast comprising opposite first and second ends, the first end of the second mast being positioned within the second cavity, a second jib including opposite first and second ends, the first end of the second jib being coupled to the second end of the second mast, a second connector coupled to the second jib, and a second hoist coupled to the platform, the second hoist comprising a second drive and a second rope, the second rope including first and second ends, the first end of the second rope being wound about the second drive, the second end of the second rope being coupled to the second connector, wherein the drives are each configured to rotate relative to the platform in a first direction to decrease a distance between the platform and the second ends of the jibs and to rotate relative to the platform in an opposite second direction to increase the distance between the platform and the second ends of the jibs.

15. A portable davit comprising:

a monolithic mounting portion configured to mount the portable davit to a davit base, the davit base being coupled to a building, the mounting portion comprising of a plate, spaced apart flanges extending distally from the plate and a top portion, end surfaces of the flanges defining distalmost surfaces of the mounting portion, the davit base comprising a planar platform and spaced apart flanges extending proximally from a top surface of the platform, the flanges of the mounting portion engaging the flanges of the davit base to align apertures of the flanges of the mounting portion with holes in the flanges of the davit base;

a base extending along a longitudinal axis between opposite proximal and distal ends, the distal end being coupled to the mounting portion, the base comprising an inner surface, an opposite outer surface that extends parallel to the longitudinal axis, a bracket, a transport wheel and spaced apart first and second flanges, the inner surface and the top surface of the base defining a cavity, the bracket being coupled directly to the outer surface, the transport wheel being coupled to the bracket, the flanges each comprising spaced apart first and second openings, the bracket and the transport wheel each being spaced apart from the mounting portion;

a mast comprising opposite first and second ends, the first end of the mast being positioned within the cavity, the mast being made from carbon fiber, the mast being rotatable relative to the base about the longitudinal axis;

a jib including opposite first and second ends and a track, the first end of the jib being coupled to the second end of the mast, the jib being made from carbon fiber, the track extending from the first end of the jib to the second end of the jib, the jib being pivotable relative to the mast to move the second end of the jib toward the base such that the jib pivots relative to the mast from a first orientation in which the jib extends transverse to mast to a second orientation in which the jib extends parallel to the mast;

a connector positioned within the track such that the connector is movable relative to the jib along the track;

a brake rotatably coupled to the connector and configured to prevent movement of the connector along the track;

a platform; and a hoist coupled to the platform, the hoist comprising a drive and a rope, the rope including first and second ends, the first end of the rope being wound about the drive, the second end of the rope being coupled to the connector, wherein the drive is configured to rotate relative to the platform in a first direction to decrease a distance between the platform and the second end of the jib and to rotate relative to the platform in an opposite second direction to increase the distance between the platform and the second end of the jib.

16. The portable davit recited in claim 15, wherein the apertures and the holes each extend perpendicular to the longitudinal axis.

* * * * *